US007327276B1

(12) United States Patent
Deconinck et al.

(10) Patent No.: US 7,327,276 B1
(45) Date of Patent: Feb. 5, 2008

(54) SECURITY SYSTEM FOR POWER AND DISPLAY OF CONSUMER ELECTRONIC DEVICES

(75) Inventors: Joseph F. Deconinck, West Babylon, NY (US); William J. Azzoli, Howard Beach, NY (US)

(73) Assignee: PROTEX International Corp., Bohemia, NY (US)

( * ) Notice: Subject to any disclaimer, the term of this patent is extended or adjusted under 35 U.S.C. 154(b) by 302 days.

(21) Appl. No.: 11/226,787

(22) Filed: Sep. 14, 2005

Related U.S. Application Data

(63) Continuation-in-part of application No. 11/082,773, filed on Mar. 17, 2005, now Pat. No. 7,209,038.

(51) Int. Cl.
*G08B 21/00* (2006.01)

(52) U.S. Cl. ..... 340/687; 340/686.1; 340/686.4; 340/568.8

(58) Field of Classification Search ..... 340/686.1, 340/686.4, 686.5, 687, 693.5, 568.1, 568.2, 340/568.8; 348/208.2, 211.4; 600/117, 118
See application file for complete search history.

(56) References Cited

U.S. PATENT DOCUMENTS

| | | | | |
|---|---|---|---|---|
| 4,746,909 | A | 5/1988 | Israel et al. | 340/568.1 |
| 5,128,770 | A * | 7/1992 | Inana et al. | 348/211.4 |
| 5,142,269 | A | 8/1992 | Mueller | 340/568.2 |
| 5,146,205 | A | 9/1992 | Keifer et al. | 340/568.2 |
| 5,172,098 | A | 12/1992 | Leyden et al. | 340/568.2 |
| 5,341,124 | A | 8/1994 | Leyden et al. | 340/568.4 |
| 5,552,771 | A | 9/1996 | Leyden et al. | 340/568.2 |
| 6,104,289 | A | 8/2000 | Rand | 340/568.4 |
| RE37,590 | E | 3/2002 | Leyden et al. | 340/568.1 |
| 6,380,855 | B1 | 4/2002 | Ott | 340/568.2 |
| 6,386,906 | B1 | 5/2002 | Burke | 439/501 |
| 6,476,717 | B1 | 11/2002 | Gross et al. | 340/568.1 |
| 6,570,502 | B2 | 5/2003 | Matsuo | 340/568.2 |
| 6,689,050 | B1 * | 2/2004 | Beutter et al. | 600/117 |
| 6,756,900 | B2 | 6/2004 | Leyden et al. | 340/568.4 |
| 6,761,579 | B2 | 7/2004 | Fort et al. | 439/501 |
| 6,799,994 | B2 | 10/2004 | Burke | 439/501 |
| 6,896,543 | B2 | 5/2005 | Fort et al. | 340/568.1 |
| 6,946,961 | B2 | 9/2005 | Frederiksen et al. | 340/568.2 |
| 6,965,397 | B1 * | 11/2005 | Honey et al. | 348/208.2 |
| 2002/0196143 | A1 | 12/2002 | Matsuo | |
| 2003/0206106 | A1 | 11/2003 | DeConinick et al. | |

* cited by examiner

*Primary Examiner*—Van T. Trieu
(74) *Attorney, Agent, or Firm*—Collard & Roe, P.C.

(57) ABSTRACT

A security system for powering and displaying a handheld electronic device includes a stand assembly mounted to a support and a housing removably mounted on a top portion of the stand assembly. The handheld electronic device is secured to a top portion of the housing and a sensor is coupled to the handheld electronic device. The sensor has a secure and a non-secure state and produces a detectable signal in the non-secure state. An output voltage controller controls an output voltage to the handheld electronic device which can be set only when the sensor is in the non-secure state. The output voltage is set to zero if the sensor is not placed in the secure state within a predetermined time.

59 Claims, 13 Drawing Sheets

SECURITY SYSTEM FOR POWER AND DISPLAY OF CONSUMER ELECTRONIC DEVICES

CROSS REFERENCE TO RELATED APPLICATIONS

This application is a Continuation-in-Part of application Ser. No. 11/082,773, filed on Mar. 17, 2005 now U.S. Pat. No. 7,209,038, the disclosure of which is hereby incorporated by reference.

BACKGROUND OF THE INVENTION

1. Field of the Invention

This invention relates to devices for securing and preventing unauthorized removal of displayed items. In particular, the invention relates to systems for displaying and securing handheld electronic devices wherein power may be provided to a displayed electronic device such that the device may be operated by a prospective purchaser.

2. The Prior Art

Handheld consumer electronic devices, for example digital cameras, camcorders, cellular phones, personal digital assistants, calculators and the like are preferably displayed in a manner such that prospective purchasers may handle and manipulate the device when contemplating a purchase. Certain handheld electronic devices, for example digital cameras and camcorders may preferably be displayed in a substantially horizontal orientation. Other handheld electronic devices, for example cellular phones, personal digital assistants and calculators may preferably be displayed at an angle with respect to the horizontal. Additionally, it is desirable to provide electronic power to such displayed devices so that prospective purchasers may operate the displayed device.

Due to their small size, accessability and value, displayed handheld consumer electronic devices are often targeted for theft. As a result, retailers often provide displayed electronic devices with an alarm sensor which produces a recognizable signal in the event of an unauthorized removal of a particular electronic device. Displayed electronic devices may also be physically secured to a support, for example with a cable or tether.

A number of systems and devices for securing displayed electronic equipment are known. U.S. Pat. Nos. 6,761,579 to Fort et al.; 6,386,906 and 6,799,994 to Burke; 6,756,900 to Leyden et al.; 6,476,717 to Gross et al. and 5,146,205 to Keifer et al. relate to mounting assemblies for video cameras. U.S. Pat. No. 5,142,269 to Mueller relates to an anti-theft system for a printer or computer.

U.S. Pat. No. 4,746,909 to Israel et al. relates to an electronic security system for monitoring merchandise. U.S. Pat. Nos. 5,172,098 and U.S. Pat. No. 5,341,124 to Leyden et al. relate to an alarm system having a plurality of sensors. U.S. Reissued Pat. No. RE37,590 to Leyden et al. relates to a retractable sensor assembly for use with an alarm system.

U.S. Pat. No. 6,104,289 to Rand relates to an anti-theft product display system including a command module, a plurality of satellites and a group of sensors. U.S. Patent Application Publication No. US 2003/0206106 to DeConinick et al. relates to an alarm interface for a merchandise security system which is coupled to an alarm system. U.S. Patent Application Publication No. US 2002/0196143 to Matsuo relates to a shoplifting monitoring apparatus including an attachment unit for attachment to an article and an alarm device that issues an alarm when the attachment unit is detached from the article.

SUMMARY OF THE INVENTION

This invention relates to devices for securing and preventing unauthorized removal of displayed items. In particular, the invention relates to systems for displaying and securing handheld electronic devices wherein power may be provided to a displayed electronic device such that the device may be operated by a prospective purchaser.

A security system according to an embodiment of the invention includes a stand assembly which is mounted to a support such as a counter, tabletop or wall. A housing is removably mounted to a top portion of the stand assembly. The housing includes a top surface which is adapted to receive a handheld electronic device, for example a digital camera, camcorder, cellular phone, personal digital assistant, or calculator. The top surface of the housing may be adapted to display the electronic device in a substantially horizontal orientation or at an angle, for example at an angle of approximately 30-60 degrees from horizontal.

A top portion of the stand assembly may comprise a collar having a cavity which is adapted to receive a portion of the housing such that the housing is centered in the stand assembly. The stand assembly may include one or more sections having a bore for routing a retractable cable coupled to the housing.

A retractable cable may be secured to the housing. The retractable cable may be, for example, a straight or coiled cable, or any flexible length of cable which is capable of being extended and/or retracted.

The handheld electronic device may be secured to the housing with a fastener, for example a threaded fastener which extends through a portion of the housing and engages an associated threaded aperture disposed on the handheld electronic device. In addition to or in place of a threaded fastener, a flexible locking band and/or an adhesive tape may be used to secure the handheld electronic device to the housing. A bracket may be provided on the top surface of the housing for preventing the handheld electronic device from rotating relative to the housing.

A sensor is adapted to be coupled to the handheld electronic device. The sensor produces a detectable signal when the handheld electronic device is moved from an authorized state, for example if the handheld electronic device is removed from the housing, transported outside a predetermined zone or if an electrical connection to the sensor is broken.

A switch may be disposed on the top surface of the housing. The switch is movable between a first position wherein the handheld electronic device is not in contact with the housing and a second position wherein the handheld electronic device is in contact with the housing. The switch may include, for example an upwardly biased contact-type switch or a folding sensor disposed between the housing and the electronic device. The folding sensor may include circuitry capable of indicating whether the electronic device is in contact with the housing. For example, the folding sensor may indicate that the electronic device is in contact with the housing when the folding sensor is in a folded state and the folding sensor may indicate that the electronic device is not in contact with the housing when the sensor is in an open, unfolded or broken state.

A output voltage controller for controlling an output voltage provided to the handheld electronic device is disposed in the housing. An output voltage may be set only when the switch is in the first position, corresponding to the condition where the handheld electronic device is not in contact with the housing. Additionally or alternatively, an output voltage may be set only when a sensor is not in a secure state. Once a desired output voltage is set, the output voltage may return to zero volts if the switch is not moved to a second position, corresponding to the condition where the handheld electronic device is in contact with the housing or if the sensor is not brought into a secure state, within a predetermined time after the output voltage has been set.

The output voltage controller may include one or more inputs for selecting a desired output voltage. The output voltage controller may include a display for displaying a selected output voltage. Preferably, the output voltage controller has an output voltage range of approximately 0.1 to approximately 10.0 volts and an output voltage may be selected in increments of approximately 0.1 volts.

The output voltage controller is coupled to the handheld electronic device with a power cable. The power cable may include a coaxial barrel plug or other modular-type plug at one end which engages with the housing and a plug at another end for engaging the handheld electronic device. A notch may be provided in a portion of the housing where the power cable engages the housing.

A satellite is in electrical communication with the output voltage controller and may receive the detectable signal from the sensor. In a security system according to an embodiment of the invention the satellite may receive a detectable signal from the sensor via a wireless communication. The satellite may include one or more audible and/or visible indicators for indicating a status of the sensor and/or switch.

The satellite includes a plurality of output jacks which are coupled to a retractable cable. The retractable cable is also coupled to the housing. A detangler may be coupled to the retractable cable. A power supply and a command module are coupled to the satellite.

In a security system according to an embodiment of the invention, the sensor may comprise a second switch disposed on the top surface of the housing, wherein the switch is movable between a first position wherein the handheld electronic device is not in contact with the housing and a second position wherein the handheld electronic device is in contact with the housing. The sensor switch may comprise, for example, an upwardly biased contact-type switch. A lever may be provided between the handheld electronic device and the housing, wherein the lever maintains one or more of the switches in a position corresponding to the handheld electronic device being in contact with the housing. A housing cover may be secured over the top surface of the housing when an electronic device is not in contact with the housing, wherein the housing cover maintains the second switch in a position as if the handheld electronic device was in contact with the housing.

Alternatively or additionally, the sensor may include a folding sensor or a pressure sensor which is disposed between the housing and the electronic device or between portions of the electronic device, for example inside a battery compartment of the electronic device. The folding sensor or pressure sensor may include circuitry capable of indicating whether the electronic device is moved from an authorized to an unauthorized state, for example if the electronic device or portion thereof is separated from the housing or transported beyond a predetermined area or zone. For example, the folding sensor or pressure sensor may indicate that the electronic device is in contact with the housing when the folding sensor is in a folded state or the pressure sensor is in a compressed state and the folding sensor or pressure sensor may indicate that the electronic device is not in contact with the housing when the sensor is in a non-compressed, open, unfolded or broken state.

The sensor may further comprise a resistance and/or capacitance type sensor, an optical sensor, a transducer, a Hall effect sensor, a magnetic sensor or any other suitable device capable of producing a detectable signal when the electronic device is moved from an authorized state.

The sensor may further comprise a conductive loop type sensor or flexible printed circuit sensor. Such sensors may be adapted to be secured to a displayed electronic device by threading a portion of the sensor through an aperture in the electronic device and In a security system according to a further embodiment of the invention, a top surface of a housing is adapted to receive a docking station of a handheld electronic device. The top surface of the housing may be substantially horizontal or angled. An output voltage controller disposed on the housing controls an output voltage to the docking station. An output voltage to the docking station can be set only when a switch disposed on the top surface of the housing is in a position corresponding to the condition where the docking station is not in contact with the housing or if a sensor coupled to a displayed electronic device associated with the docking station is not in a secure state. Once set, an output voltage may return to zero volts if the switch is not moved to a second position, corresponding to the condition where the docking station is in contact with the housing, or if the sensor is not put into a secure state, within a predetermined time after the output voltage has been set. The docking station is coupled to the housing with a power cord. A sensor is adapted to couple the handheld electronic device to the housing, wherein the handheld electronic device engages the docking station. The sensor produces a detectable signal which is received by a satellite when the handheld electronic device is moved from an authorized state.

In a security system according to a further embodiment of the invention, a top surface of the housing or a platform secured to a top surface of the housing is adapted to display an electronic device and/or a docking station at an angle with respect to the horizontal. For example, an electronic device secured to the top surface of the housing or a platform secured thereto may be displayed at an angle of approximately 30-60 degrees from the horizontal.

An advantage of a security system according to an embodiment of the invention is that an output voltage controller is provided for selecting an appropriate voltage to be delivered to a displayed electronic device. As voltage is selected and regulated via an adjustable output voltage controller, rather than by a power cable, the need for multiple power cables adapted for powering various electronic devices having differing input voltage requirements is eliminated.

Another advantage of a security system according to an embodiment of the invention is that an output voltage controller is provided wherein an output voltage may be set only when an electronic device to be powered is not coupled to a housing or a sensor coupled to the electronic device is not in a secure state. Furthermore, an output voltage to an electronic device is returned to zero if: 1) an electronic device is not coupled to the housing or a sensor coupled to the electronic device is not placed in a secure state within a predetermined period of time after setting an output voltage; or 2) if power to an electronic device has been enabled and the electronic device is removed from the housing or a sensor coupled to the electronic device is placed in a non-secure or alarmed state. These features greatly reduce the likelihood of providing an inappropriate voltage level to an electronic device via the output voltage controller, thereby damaging the electronic device.

Another advantage of a security system according to an embodiment of the invention is that an internal battery is provided for powering an output voltage controller disposed in a portable housing, so that a voltage level may be set and retained without the portable housing or output voltage controller being coupled to an external power source.

Another advantage of a security system according to an embodiment of the invention is that an adjustable stand assembly is provided which permits secured electronic devices to be displayed at various heights and in various orientations. The stand assembly may include a collar portion which interacts with a removable housing to which an electronic device is mounted such that the removable housing automatically centers itself upon insertion into the stand assembly.

Another advantage of a security system according to an embodiment of the invention is that a bracket may be provided in a housing to which an electronic device is secured, wherein the bracket prevents the electronic device from rotating with respect to the housing, thereby preventing and/or inhibiting an unauthorized removal of the electronic device from the housing.

Another advantage of a security system according to an embodiment of the invention is that a notch may be provided in a portion of a housing where a power cable supplying power to a secured electronic device is coupled to the housing. The notch may serve to prevent or inhibit an unauthorized removal of the power cord once the electronic device has been secured to the housing. The power cord may be situated in the housing such that once the power cord and sensor are coupled to the housing, the power cable cannot be removed from the housing without first removing the sensor from the housing, thereby securing the power cable.

BRIEF DESCRIPTION OF THE DRAWINGS

These and other benefits and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENTS

Figure 1:
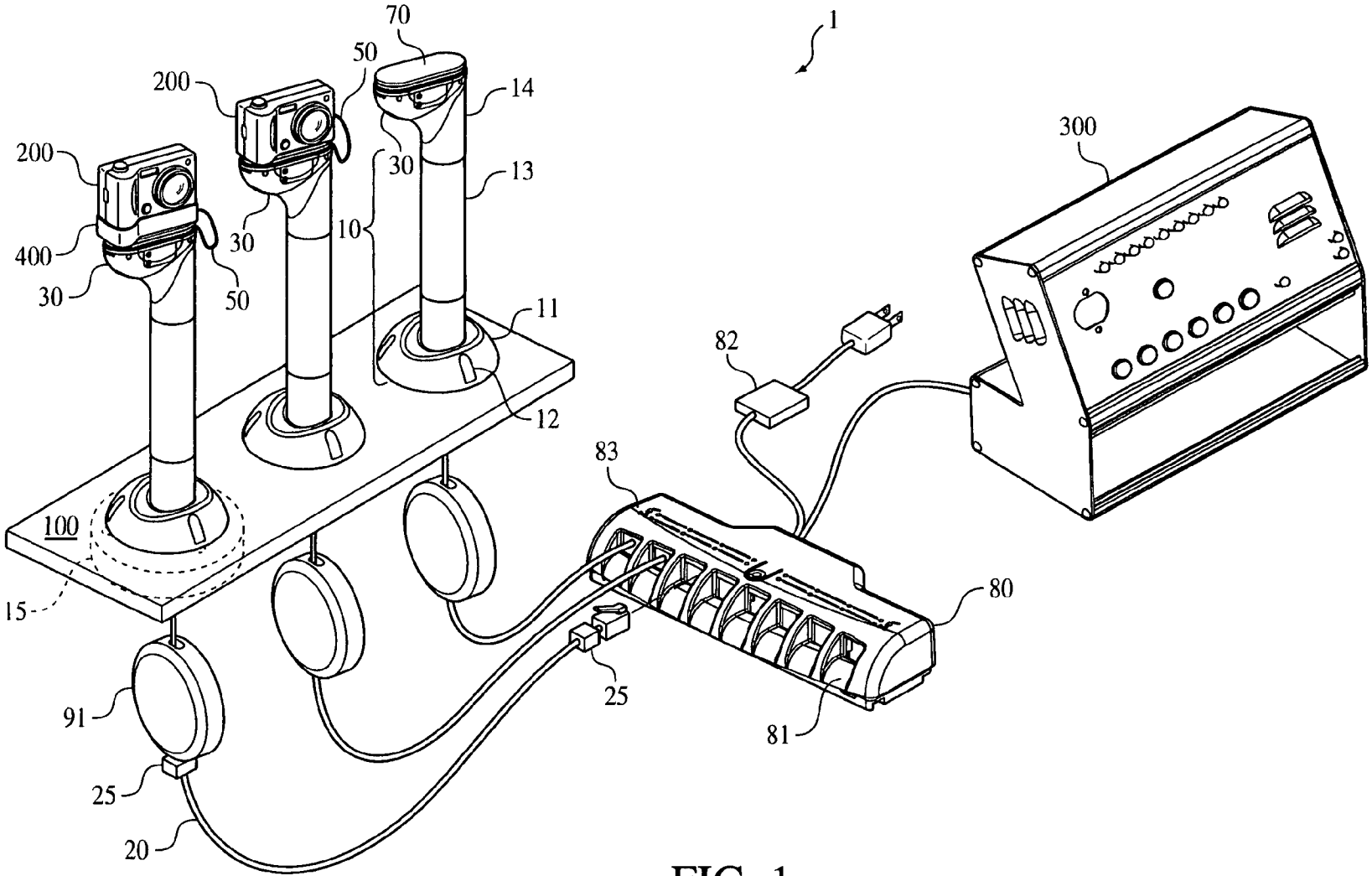
FIG. 1 shows a schematic view of a security system according to an embodiment of the invention.

Referring now in detail to the drawings and, in particular, FIG. 1 shows a schematic view of a security system for displaying a handheld electronic device according to an embodiment of the invention. As shown in FIG. 1, security system 1 may include a stand assembly 10 which is mounted to a support 100, for example a display counter, tabletop or wall. Stand assembly 10 supports housing 30 and displayed handheld electronic device 200 and conceals a retractable cable 20 which is routed to housing 30.

Stand assembly 10 may be mounted to support 100 using a flange 15 positioned under support 100 and one or more fasteners, for example threaded fasteners or screws, which pass through notches provided in a base portion 11 of stand assembly 10. By using fasteners of appropriate lengths, the base 11 and flange 15 combination is adaptable to supports of various thicknesses. In this way stand assembly 10 is compatible with and may be mounted to a wide range of supports, for example display counters, tabletops and/or walls having various configurations and thicknesses.

Base portion 11 may serve to conceal the stand assembly mounting hardware and provide an aesthetically pleasing, streamlined look to the stand assembly. Molded caps 12 may be inserted into the notches to conceal the presence of the screws. By rotating the components of stand assembly 10, the assembly may be positioned to selectively display a preferred side of handheld electronic device 200.

Stand assembly 10 may comprise one or more sections 13 wherein each section 13 includes a bore for routing a retractable cable 20 which is coupled to a housing 30. Sections 13 may comprise one or more tubular sections of various lengths. For example, sections 13 may have lengths of approximately three inches and six inches and may be combined to produce stand assemblies of various heights. In this way, stepped displays of handheld electronic devices may be created. This feature is particularly advantageous when multiple stand assemblies are arranged in rows, wherein a stand assembly in a rear row may be arranged with a greater height than a stand assembly in a front row for greater visibility of the displayed handheld electronic devices.

Sections 13 may include internal and/or external threaded surfaces for engaging adjacent sections. A bottom section may engage with a threaded boss which extends through support 100 and may be secured by an anti-rotation screw disposed in base portion 11 which prevents the bottom section of the stand assembly 10 from loosening.

Housing 30 is removably mounted a top portion of stand assembly 10. Collar 14 comprises the uppermost section of stand assembly 10. Collar 14 may have a cavity adapted to receive a lower portion of housing 30 which rests in collar 14. The cavity in collar 14 and lower portion of housing 30 may be shaped such that housing 30 is centered in stand assembly 10 when removably mounted thereon. For example, an internal surface of collar 14 may be contoured so as to guide a lower portion of housing 30 into stand assembly 10 as a lower portion of housing 30 is inserted into collar 14 and to maintain housing 30 in a preferred centered orientation when a lower portion of housing 30 is fully inserted into collar 14.

Figure 2:
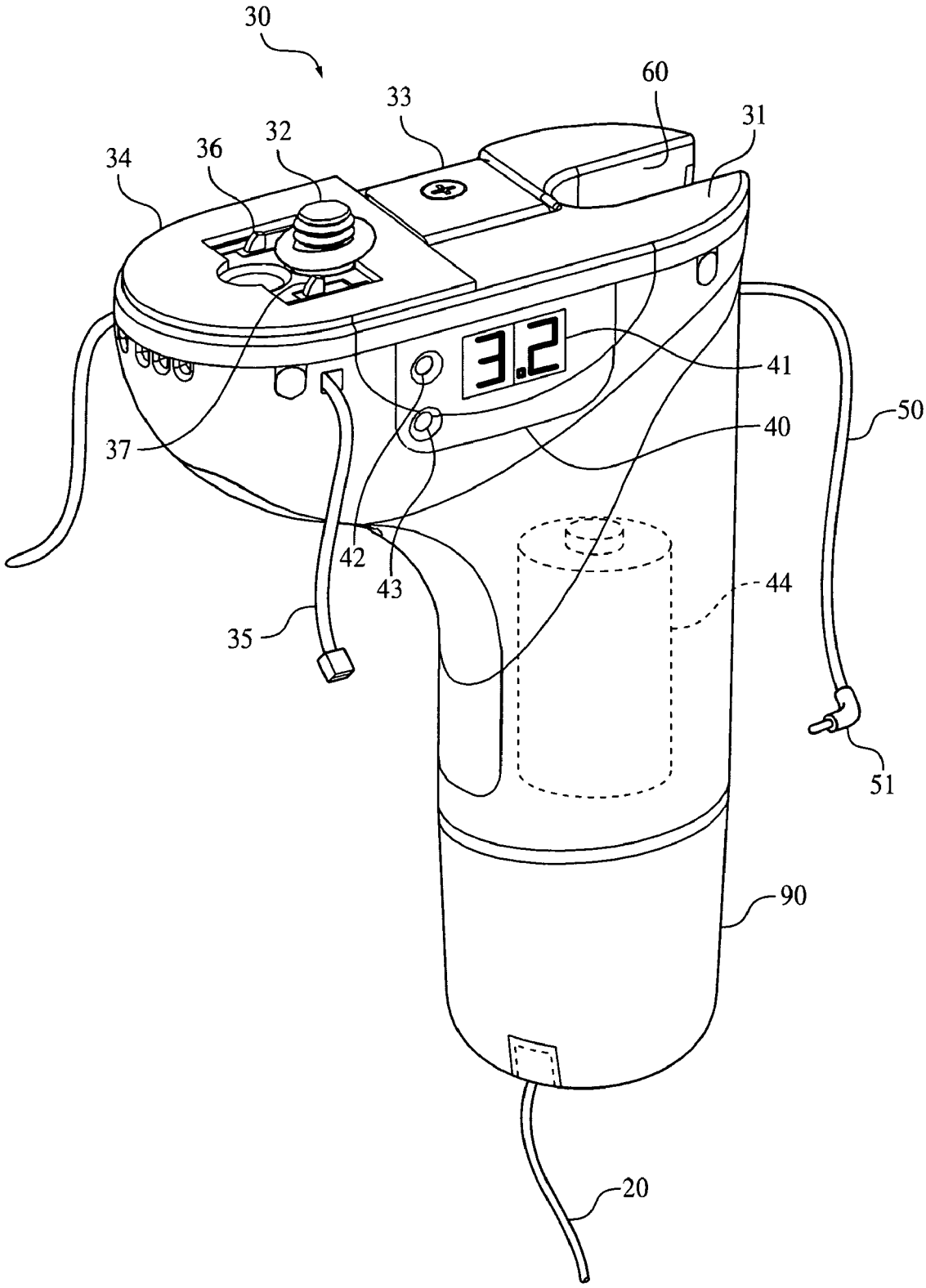
FIG. 2 shows a perspective view of a housing according to an embodiment of the invention.

Housing 30 sits atop stand assembly 10. As shown in FIG. 2, housing 30 may have an ergonomic shape such that is comfortable for a prospective purchase to hold in his or her hand. A top surface 31 of housing 30 is adapted to receive a handheld electronic device 200, for example a digital camera, camcorder, cellular phone, personal digital assistant, or calculator.

Handheld electronic device 200 may be secured to housing 30 to prevent its removal from housing 30. For example, as shown in FIG. 2 a threaded fastener 32 may be disposed in housing 30 and extend through top surface 31. Threaded fastener 32 may engage a corresponding threaded aperture in handheld electronic device 200. In one embodiment, threaded fastener 32 may comprise a ¼-20 screw which engages a tripod mounting aperture disposed on an undersurface of handheld electronic device 200.

A bracket 33 maybe disposed on top surface 31 of housing 30 for preventing rotation of handheld electronic device 200 relative to housing 30. When handheld electronic device 200 is secured to housing 30, bracket 33 may prevent handheld electronic device 200 from rotating such that threaded fastener 32 is disengaged from handheld electronic device 200, thereby permitting removal of handheld electronic device 200 from housing 30. When not in use, bracket 33 may be flipped over and stored within housing 30 as shown in FIG. 2.

Handheld electronic device 200 may be secured to housing 30 with adhesive tape 34. As shown in FIG. 2, adhesive tape 34 is disposed on top surface 31 of housing 30. Adhesive tape 34 may comprise a double sided adhesive tape and may be used in addition to threaded fastener 32 or as an alternative to threaded fastener 32.

A locking flexible band 35 may be used to secure handheld electronic device 200 to housing 30. Locking flexible band 35 may extend through an aperture provided in housing 30 as shown. Alternatively, locking flexible band 35 may extend through an aperture provided in a plug or fastener disposed in an opening in the housing, such as an opening provided for threaded fastener 32 or may be looped around a portion of housing 30. Locking flexible band 35 is further looped around handheld electronic device 200 and secured so as to secure device 200 to housing 30. Locking flexible band 35 may comprise, for example a tie wrap or wire wrap-style connector.

A switch 36 is disposed on top surface 31 of housing 30. Switch 36 is movable between a first position when handheld electronic device 200 is not in contact with housing 30 and a second position when handheld electronic device 200 is in contact with housing 30. For example, switch 36 may be upwardly biased such that it is in an open position when no handheld electronic device 200 is in contact with switch 36 and such that it is pushed downward into a closed position by an under surface of handheld electronic device 200 when handheld electronic device 200 is mounted to housing 30. Alternatively, a switch may include a folding sensor disposed between the housing and the electronic device. The folding sensor may include circuitry capable of indicating whether the electronic device is in contact with the housing.

An output voltage controller 40 is disposed in housing 30. Output voltage controller controls an output voltage which is provided to power handheld electronic device 200 via power cable 50. Various handheld electronic devices each have a specific input voltage requirement. Output voltage controller 40 allows a user to select an appropriate voltage from a plurality of available voltages for powering the particular handheld electronic device 200 secured to the associated housing 30. Output voltage controller 40 eliminates the need for multiple, voltage specific-power cords which must be selected and matched with each handheld electronic device to be powered and displayed. Output voltage controller 40 similarly eliminates the need for individual, device specific batteries to power displayed electronic devices.

Output voltage controller 40 may include a display unit 41 which displays a current voltage output. Output voltage controller may also include one or more inputs 42, 43 for setting a desired output voltage. Inputs may comprise, for example, two buttons disposed on a side of housing 30. One input button 42 may increase an output voltage of the output voltage controller 40 when depressed and another button 43 may decrease an output voltage of output voltage controller 40 when depressed. Output voltage controller 40 may have a speed scroll function, wherein if one or more of input buttons 42, 43 is depressed for a set period of time, output voltage control 40 scrolls through output voltages at an increased rate.

Output voltage controller 40 may also comprise a mechanically controlled device. For example, an output voltage may be selected from a plurality of available voltages by inserting an appropriate pin-type connector or jumper into a portion of the output voltage controller. The pin-type connector completes a circuit to deliver an appropriate output voltage. A plurality of pin-type connectors may be provided wherein each is associated with a particular output voltage. Furthermore, an output voltage may be selected via a mechanical dial having a plurality of settings each corresponding to a desired output voltage.

Output voltage controller 40 may have an output voltage range of approximately 0.1 to 10.0 volts and may be adjustable in increments of approximately 0.1 volts. As a result, a security system according to an embodiment of the invention may be used to provide power to a wide variety of handheld electronic devices to be powered and displayed. Additionally, an appropriate voltage for powering a particular electronic device can be selected from an available voltage range with a high degree of precision.

A battery 44 may be disposed in housing 30 and coupled to output voltage controller 40. Battery 44 provides power to output voltage controller 40 such that an output voltage can be set and retained without housing 30 and output voltage controller 40 being connected to an external power supply. In this way a housing and associated handheld electronic device may be moved, shelved or otherwise disconnected from the remaining components of the security system without loss of the voltage setting. Battery 44 may supply power to one or more of output voltage controller 40, handheld electronic device 200, other housing circuitry and a sensor which provides a detectable signal when handheld electronic device 200 is moved from an authorized state.

If an output of battery 44 runs down and housing 10 is connected to an external power supply, display unit 41 may display a message indicating that battery 44 is low, for example the symbol "LO". Such display may be continuous or periodic, for example appearing once every two minutes. Additionally, an audible signal, for example a chirp, may be produced to indicate a low battery 44.

Battery 44 may comprise a rechargeable battery, wherein stand assembly 10 may include a wireless, induction-type charger for charging battery 44. For example, a portion of stand assembly 10 and a portion of housing 30 may form a two part transformer for charging battery 44. The transformer may comprise one or more coils of electrically conducting wire disposed in or on the housing and/or stand assembly. Electrical power may be supplied to the coil in stand assembly 10 which charges battery 44 when housing 30 is inserted into stand.

In this way, electrical power may be provided to a handheld electronic device 200 or a sensor coupled to housing 30 without the need to secure an electrically conducting cord or wire to housing 30. Power for the handheld electronic device 200, sensor, output voltage controller 40 and other housing 30 circuitry is provided by the internal rechargeable battery 44 which is charged by non-contact means when housing 30 is seated in stand assembly 10. When coupled with a wirelessly communicating security sensor, such a system provides wireless power and security for one or more handheld electronic devices 200. Such as configuration is shown, for example, in schematic form at FIG. 18. Additionally, housing 30 may be secured with a mechanical tether for providing additional security.

Output voltage controller 40 is coupled to switch 36 such that an output voltage can be set only when switch 36 is in a first position corresponding to a condition wherein handheld electronic device 200 is not in contact with housing 30.

Once an output voltage is set, output voltage controller 40 may reset the output voltage to zero volts if switch 36 is not moved to a second position, corresponding to the condition where handheld electronic device 200 is in contact with housing 30, within a predetermined time after the output voltage has been set. For example an output voltage may be reset to zero automatically if a handheld electronic device is not brought into contact with housing 30 such that switch 36 is tripped within two minutes of setting an output voltage. Additionally, an output voltage of output voltage controller 40 may be reset to zero if handheld electronic device 200 is removed from housing 30, such that switch 36 is moved to a position corresponding to this condition.

This "auto-zeroing" function of output voltage controller 40 protects against inadvertently providing an inappropriate voltage to a handheld electronic device. This inadvertent mispowering could otherwise occur, for example, when one handheld electronic device is removed from a housing and replaced with another handheld electronic device having a different input voltage requirement or when an output voltage is set and the housing is left unattended for a period of time without securing a handheld electronic device to the housing. Accordingly, the auto-zeroing capability of output voltage controller 40 prevents damage to handheld electronic devices which might otherwise result from applying an inappropriate voltage level to the device.

In the event that an output voltage is reset to zero due to the handheld electronic device not being brought into contact with housing 30 within a required time or a handheld electronic device being removed from a housing, an audible signal, for example a buzzing sound, may be produced and display 41 may turn off. Toggling one or both of switches 36, 37 may extend the time limit for bringing the handheld electronic device into contact with housing for an additional amount of time, for example an additional two minutes.

Once an output voltage has been set and a handheld electronic device 200 has been brought into contact with housing 30, the output voltage to handheld electronic device 200 may not be enabled until handheld electronic device 200 has been coupled to housing for a predetermined period of time, for example for thirty seconds. Once an output voltage is enabled, display unit 41 may turn off. Depressing either or both of the voltage up and/or down inputs 42, 43 may awaken display 41 such that display 41 shows the selected voltage output for a period of time, for example ten seconds, for power verification. However, once power to handheld electronic device is enabled, a voltage output may not be edited or changed.

The functions of the output voltage controller may be controlled by a micro controller. Output voltage may be regulated by a buck topology controller or any other suitable controller.

Output voltage controller 40 is coupled to handheld electronic device 200 with power cable 50. Power cable 50 may include a coaxial barrel plug at one end which engages with housing 30 and a plug 51 at another end for engaging handheld electronic device 200. Plug 51 may be adapted to fit a plurality of handheld electronic devices or a specific handheld electronic device. Since an output voltage for an associated handheld electronic device is set by output voltage controller 40 and not by power cable 50, multiple power cables with the same plug but differing output voltages are not required. This feature greatly reduces the number of power cables which a user of a security system according to an embodiment of the invention must stock in order to accommodate various handheld electronic devices.

If a short circuit occurs in power cable 50 or retractable cable 20, display unit 41 may display a message indicating this condition, for example display unit 41 may display the message "OL" and output voltage controller 40 will disable the output voltage to handheld electronic device 200.

A notch 60 may be provided in a portion of the housing 30 where power cable 50 engages housing 30. Power cable 50 may be coupled to housing 30 within notch 60 and coupled to handheld electronic device 200 at an under surface of handheld electronic device 200. In this way, power cable 50 may be secured against removal during use as it is trapped under handheld electronic device 200 which is secured to housing 30. Thus power cable 50, once installed, can be removed only when handheld electronic device 200 is removed from housing 30.

A sensor adapted to be coupled to handheld electronic device 200 produces a detectable signal when handheld electronic device 200 is moved from an authorized state, as for example when a shoplifter attempts to remove handheld electronic device 200 from housing 30 or when handheld electronic device 200 is transported outside a predetermined zone.

The sensor may comprise, for example a switch 37 disposed on top portion 31 of housing 30 as shown in FIG.

2, wherein switch 37 is moveable between a first position wherein handheld electronic device 200 is not in contact with housing 30, and corresponding to an alarm condition, and a second position, wherein handheld electronic device 200 is in contact with housing 30, and corresponding to a non alarmed condition. A single switch may serve both as means for determining whether a handheld electronic device 200 is in contact with the housing 30 and as a means for producing a detectable signal when handheld electronic device 200 is removed from housing 30 in an unauthorized manner.

Alternatively, a sensor for producing a detectable signal when handheld electronic device 200 is moved from an authorized state may comprise an inductance, resistance and/or capacitance type sensor, a magnetic or acousto-magnetic-type sensor, an etched circuit folding tag, and/or a pressure or optical sensing transducer.

A sensor may include a mechanically activated sensor, for example an outwardly biased plunger mechanism which is secured to handheld electronic device 200 such that a plunger portion is inwardly displaced. Such a sensor may indicate an alarm condition when removed from handheld electronic device 200, thereby allowing a plunger portion to return to its normally outwardly biased position.

A sensor for producing a detectable signal when handheld electronic device 200 is moved to an unauthorized state may communicate with a satellite 80 and or/a command module 300 via an electrically conducting wire or wirelessly. For example, a sensor may communicate with satellite 80 and/or command module 300 by low, high, radio or microwave frequency signals, or by other wireless means. Transmitters, receivers and/or transceivers may be provided on the sensor, housing 30, satellite 80 and or command module 300 for wireless communication. For example, a sensor may comprise a magnetic sensor or an inductor-capacitor type sensor which produces a detectable signal in response to the presence or absence of a transmitted magnetic or electrical field.

A plurality of light emitting diodes (LEDs) may be disposed on housing 30 for indicating a power and/or sensor status. For example, an amber LED may be disposed on a back portion of housing 30 and may light when power to handheld electronic device is enabled. A green LED disposed on a front portion of housing 10 may light when a sensor is not producing a detectable signal indicating that handheld electronic device has been moved from an authorized state (a non-alarm condition). A red LED disposed on a front portion of housing 10 may light when a sensor is producing a detectable signal indicating that handheld electronic device has been moved from an authorized state (an alarm condition).

A lever may be provided for use when handheld electronic device 200 has a narrow or thin profile such that a bottom portion of handheld electronic device 200 does not contact one or both of switch 36 and switch 37 when handheld electronic device 200 in secured to housing 30. The lever may comprise a thin strip positioned between handheld electronic device 200 and top surface 31 of housing 30. The lever may extend across a width of top surface 31 of housing 30 and contact one or both of switches 36, 37 such that switches 36, 37 are triggered when handheld electronic device 200 is mounted to housing 30.

A housing cover 70 may be provided for use when a handheld electronic device is not disposed on housing 30, as shown in the assembly on the right hand side in FIG. 1. Housing cover 70 is adapted to be secured to top surface 31 of housing 30 in the manner of handheld electronic device 200. Housing cover may maintain switch 37 in a position as if a handheld electronic device were in contact with housing 30, thereby simulating a non-alarmed condition. Housing cover 70 may have a profile corresponding to that of top surface 31 of housing 30 and may comprise a relatively thin sheet of material, for example approximately 0.25 inches in thickness.

As shown in FIG. 1, a satellite 80 has a plurality of output jacks 81. For example satellite 80 may include eight output jacks as shown. Satellite 80 receives the detectable signal produced by a sensor when handheld electronic device 200 is moved from an authorized state. Satellite 80 may receive a detectable signal from sensor via a wireless communication or via a wire or cable.

Retractable cable 20 is coupled at one end to an output jack 81 of satellite 80 and at another end to housing 30. As shown in FIG. 2, a detangler 90 may be provided where retractable cable 20 couples to housing 30. Detangler 90 permits housing to be freely rotated when coupled to retractable cable 20 without tangling retractable cable 20 and interfering with the recoiling of retractable cable 20. Retractable cable 20 may be coupled to a retractor 91 for recoiling retractable cable 20. Retractable cable may comprise one or more discrete lengths of cable, for example one length of cable may extend between housing 30 or detangler 90 and retractor 91 and another length of cable may extend between retractor 91 and satellite 80. Strain relief mechanisms 25 may be provided at one or more terminal ends of retractable cable 20 to prevents disconnection or decoupling of retractable cable 20.

Retractable cable 20 may be a single or multiconductor cable and may be flat, round or any suitable shape. Retractable cable 20 may have a suitable connection element at one or both terminal ends adapted to couple retractable cable 20 to output jack 81, housing 30, detangler 90 and retractor 91. Retractable cable 20 may provide power to handheld electronic device 200 and or a means for communicating with a sensor which produces a detectable signal when the handheld electronic device 200 is moved from an authorized state. Alternatively, separate, discrete cables may be provided, wherein one cable provides electrical power to handheld electronic device 200 and another cable provides communication with a sensor. Furthermore, power to handheld electronic device 200 and communication with sensor may both be provided wirelessly, in which case retractable cable 20 may serve only as a mechanical tether for securing housing 30 to the system.

Satellite 80 may be in electrical communication with output voltage controller 40 via retractable cable 20. A power supply 82 is coupled to satellite 80. Power supply 82 provides power to satellite 80 and to output voltage controller 40 via retractable cable 20. Each satellite may power and secure multiple housings and associated handheld electronic devices. For example one satellite may power and secure eight housings and associated handheld electronic devices. Multiple satellite may be coupled together, for example ten satellites may be daisy chained together for powering and securing up to eighty handheld electronic devices.

Satellite 80 may include a visible and or audible indicator for indicating a status of the sensor. Satellite 80 may include a visible or audible indicator for indicating a status of switch 36. For example a plurality of light emitting diodes (LEDs) 83 may be disposed on satellite 80 behind an output jack 81 associated with a particular housing and handheld electronic device. A green LED may light if a sensor is in a non-alarmed state indicating that a corresponding handheld electronic device has not been moved from an authorized state. A red LED may light if a sensor is in an alarmed state indicating that a corresponding handheld electronic device has been moved from an authorized state. Additionally, an amber LED may light if power supply 82 is supplying power to satellite 80 and an output jack 81 associated with the LED is coupled to a retractable cable 20 which does not have a short circuit or other fault. If such a fault is present, the amber LED will not light and power will not be delivered to the particular output jack. An internal resettable fuse may be provided to protect the output jack in the event of a short or other fault. Each satellite may have a local audible alarm which sounds when an alarm condition exists in a sensor associated with that satellite, that is when a sensor produces a detectable signal indicating that a handheld electronic device coupled to the alarming sensor has been moved from an authorized state. Each satellite 80 may include a manual reset for a local alarm, for example by a push button disposed on satellite 80.

A command module 300 is coupled to satellite 80. Command module 300 provides a central control hub for the security features of the system. Security information, including sensor status, is communicated between command module 300 and connected satellites 80. Security system 1 may be armed and disarmed using command module 300. For example, command module 300 may be provided with a keypad input or mechanical key input for arming and disarming security system 1. Command module 300 may also control an alarm volume, alarm type, local alarm, and local alarm reset. Command module 300 may also have an external horn for indicating an alarm condition.

Additionally, some or all of the above-described functions of satellite 80 and command module 300 may be performed by a single control unit which may be remote from and coupled to one or more stand and housing assemblies. For example, a single control unit may receive detectable signals from one or more sensors associated with one or more handheld electronic devices and may provide power to one or more handheld electronic devices via an associated housing.

A further embodiment of the invention is shown in the left hand assembly illustrated in FIG. 1. This embodiment is similar to the system described above, however a docking station for a handheld electronic device as well as the device itself is powered. Here, a top portion of a housing receives a docking station 400 for a handheld electronic device 200. Power is suppled to docking station 400 via power cable 50. A switch on a top surface of the housing 30 is movable between a first position when docking station 400 is not in contact with housing 30 and a second position when docking station 400 is in contact with housing 30. Handheld electronic device 200 is coupled to docking station 400 and powered via docking station 400. An output voltage controller provides an appropriate output voltage to docking station 400 as described above. Both docking station 400 and handheld electronic device 200 may be secured to housing 30

Figure 3:
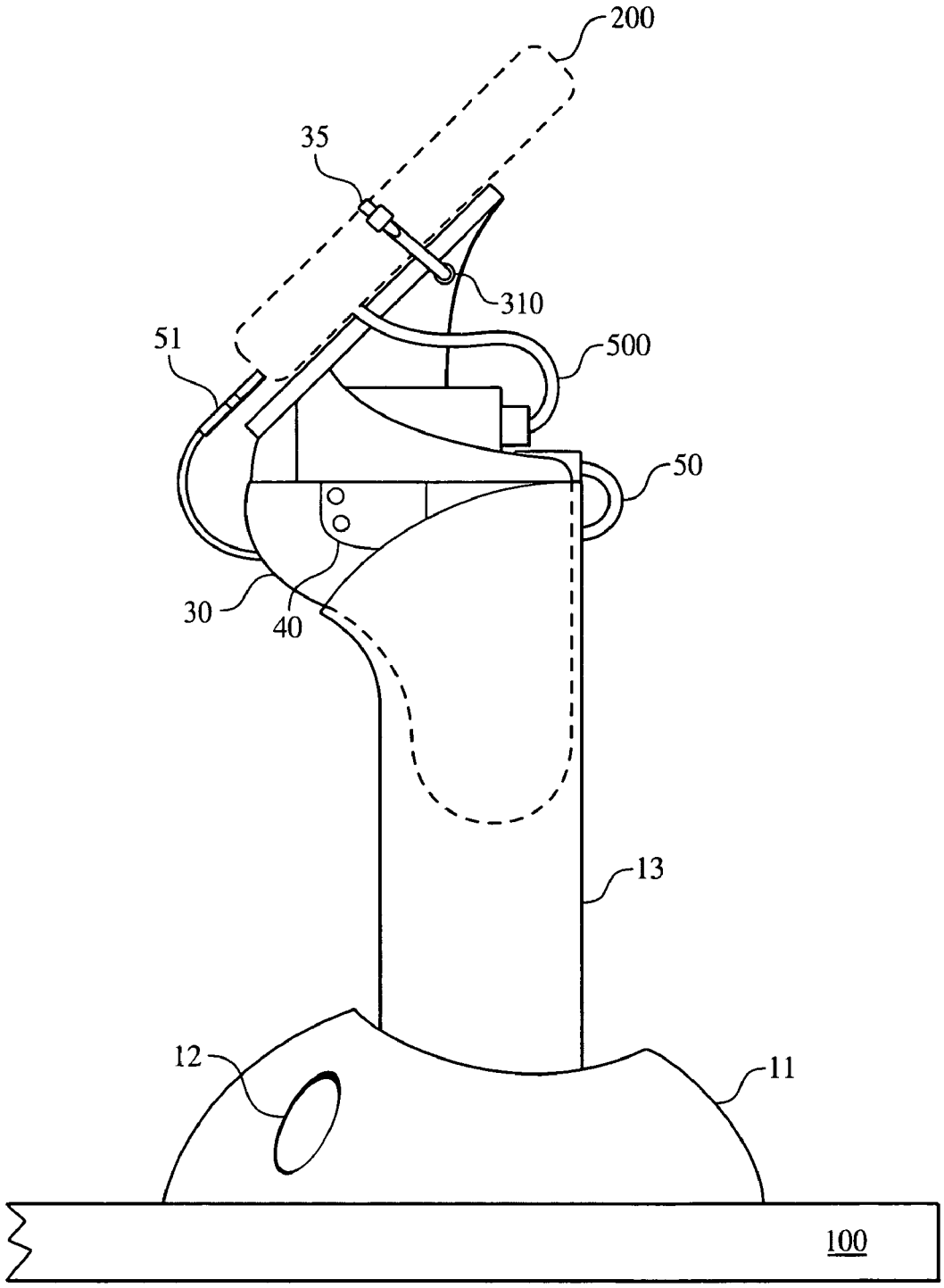
FIG. 3 shows a side view of a security system according to another embodiment of the invention.

FIG. 3 shows a side view of a security system according to another embodiment of the invention. As shown in FIG. 3, a top portion of housing 30 may be provided with an angled platform 310 or otherwise adapted to display handheld electronic device 200 at a predetermined angle when electronic device 200 is secured to housing 30 or platform 310. Angled platform 310 or housing 30 may, for example, hold displayed electronic device 200 at an angle of approximately 30-60 degrees, preferably 45 degrees, with respect to the horizontal. Such an orientation is especially desirable for the display of certain handheld electronic devices, for example cellular phones, personal digital assistants, calculators and the like.

Housing 30 is removably mounted to a top portion of a stand assembly comprising one or more sections 13 and a base 11 which are secured to a support 100 as described with respect to FIG. 1. Handheld electronic device 200 may be mechanically secured to housing 30 or angled platform 310 with an adhesive element, such as double sided tape. In addition to or as an alternative to an adhesive element, electronic device 200 may be mechanically secured to platform 310 or housing 30 with a locking flexible band 35, for example a tie wrap or wire wrap style connector. As shown in FIG. 3, locking flexible band 35 may extend through an aperture provided in housing 30 or platform 310 and loop around handheld electronic device 200. Locking flexible band 35 is secured to mechanically fasten handheld electronic device 200 to housing 30 or platform 310.

Figure 4:
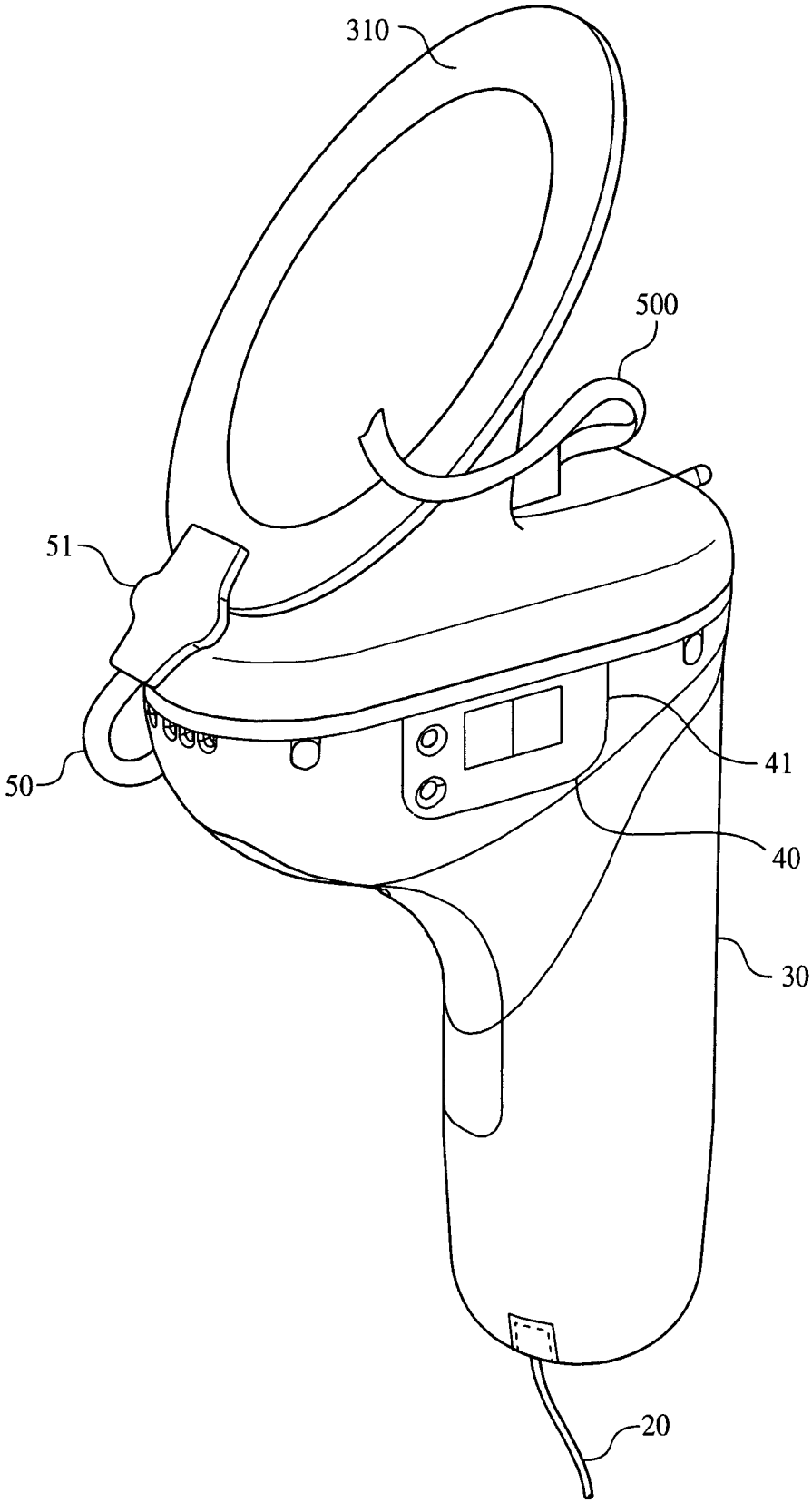
FIG. 4 shows a front perspective view of a housing according to the embodiment shown in FIG. 3.

Output voltage controller 40 may be disposed in housing 30 for controlling an output voltage to power electronic device 200 via power cable 50. As shown in FIGS. 3 and 4, power cable 50 includes a plug 51 which is adapted to couple power cable 50 to a particular displayed electronic device 200. Plug 51 may be a male or female-type connector which is suited to engage a corresponding connector on a particular brand and/or model of electronic device to be displayed.

Figure 5:
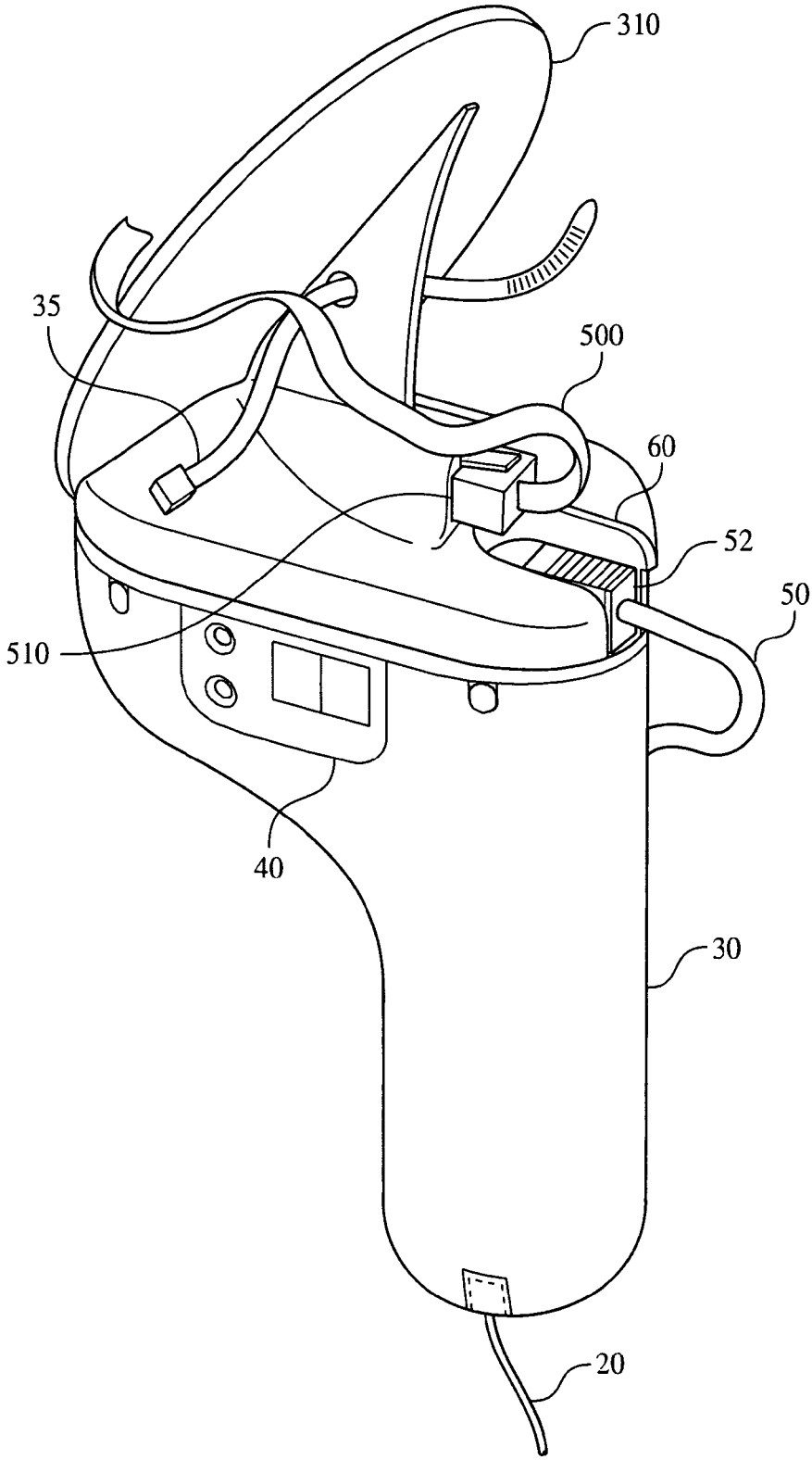
FIG. 5 shows a rear perspective view of the housing shown in FIG. 4.

As show in FIG. 5, power cable 50 further includes a connector 52 for coupling power cable 50 to output voltage controller 40 via housing 30. Connector 52 may comprise, for example, a modular connector adapted to engage a corresponding connector in housing 30. Power may be provided for powering electronic device 200 via retractable cable 20. Retractable cable 20 may provide a direct current or alternating current input voltage to output voltage controller 40. Output voltage controller 40 allows a user to select an appropriate output voltage for a particular electronic device to be powered as provided in the foregoing description. An appropriate voltage to power electronic device 200 is supplied via power cable 50 which is electronically coupled to output voltage controller 40 and electronic device 200.

As shown in FIG. 5, a slot or notch 60 may be provided in housing 30 at a location where power cable connector 52 engages housing 30. Sensor modular connector 510 may engage housing 30 at a location over engaged power cable connector 52. The two connectors are arranged so that once power cable connector 52 is engaged with housing 30 and sensor modular connector 510 is engaged with housing 30, power cable cannot be disengaged from housing 30 without first removing sensor modular connector 510, thereby putting sensor 500 into a non-secure or alarm state wherein sensor produces a detectable signal.

For example, power cable connector 52 may engage housing 30 in notch 60 by inserting power cable connector 52 into a complementary jack or connection in housing 30 in a downward direction. Accordingly, power cable connector 52 may be disengaged or removed from housing 30 only by pulling on power cable connector 52 in an upward direction. When sensor modular connector 510 is engaged with housing 30, such upward movement of power cable connector 52 is prevented, thereby securing power cable connector 52 from unauthorized removal.

A sensor assembly 500 may be secured to electronic device 200. Sensor assembly 500 produces a detectable signal corresponding to a state or condition which may indicate an attempted or actual unauthorized removal of, or tampering with, a displayed electronic device 200. For example, sensor assembly 500 may produce a detectable signal 1) if the sensor assembly is disconnected from either housing 30, platform 310 or electronic device 200; 2) if electronic device 200 is removed from housing 30 or platform 310; 3) if a break or discontinuity is present in sensor assembly 500 and/or retractable cable 20 (as for example if the sensor or cable is cut or sliced); and/or 4) if the sensor assembly is moved from an authorized area or interrogation zone. The detectable signal produced by sensor assembly 500 triggers an alarm when the system is in an armed state. The system may be disarmed to allow authorized persons to freely move and disconnect electronic devices, housings and/or sensor assemblies without producing an alarm.

Sensor assembly 500 may include a modular connector 510 disposed at one end. Modular connector 510 is adapted for coupling sensor assembly 500 to housing 30. Modular connector 510 may comprise, for example a male phone jack-type connector, a coaxial cable connector, or any other suitable connector.

Examples of different types of sensor assemblies 500 which can be used with a security system according to various embodiments of the invention are shown in FIGS. 6-9. Each of the sensor assemblies shown in FIGS. 6-9 may be used with either or both of the security system embodiments shown in FIGS. 1 and/or 3.

Figure 6:
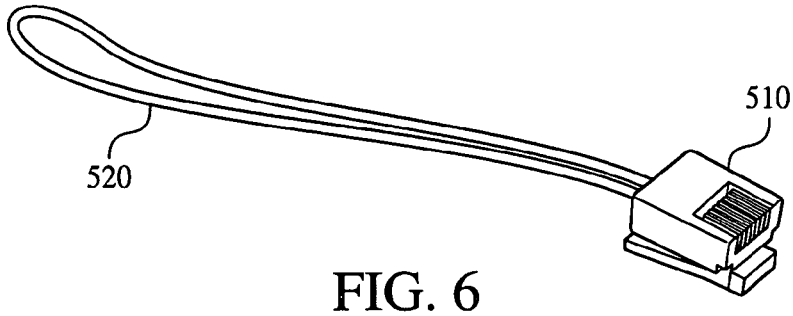
FIG. 6 shows a sensor for use with a security system according to an embodiment of the invention.
Figure 11:
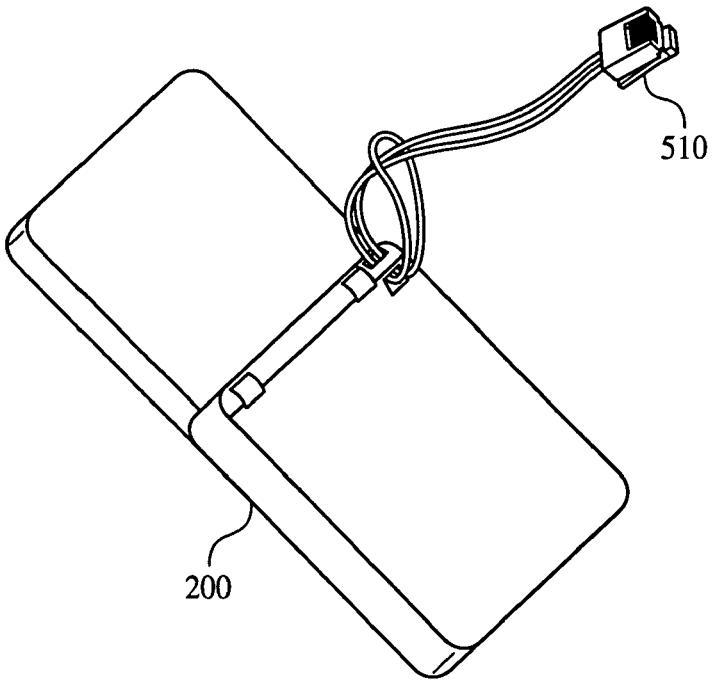
FIG. 11 shows the sensor of FIG. 6 secured to an electronic device according to an embodiment of the invention.

FIG. 6 shows a wire loop sensor assembly. The assembly includes modular connector 510 for coupling the sensor assembly 500 to housing 30. The assembly further comprises a thin, flexible continuous length of wire 520. The length of wire 520 is secured at each end to modular connector 510 so as to a loop. The wire loop sensor assembly may be secured to a displayed electronic device by threading an end of wire length 520 opposite modular connector 510 through an opening or aperture in electronic device 200, inserting modular connector 510 through the closed loop and drawing it tight and securing modular connector 510 to housing 30, thereby providing a secure connection. For example, as shown in FIG. 11, a wire loop sensor assembly may be threaded through a wrist strap opening provided in a cellular phone, personal digital assistant or similar device.

The wire loop sensor produces a detectable signal if the wire is broken or cut and/or if modular connector 510 is removed from housing 30. In this way, once a wire loop sensor is secured to an electronic device 200 and housing 30, the electronic device 200 cannot be removed from housing 30 without producing a detectable signal which triggers an alarm when the system is in an armed mode. The detectable signal produced by the wire loop sensor may be transmitted to satellite 80 and/or command module 300 via wireless transmission, along retractable cable 20 or via another cable coupling housing 30 to satellite 80.

Figure 7:
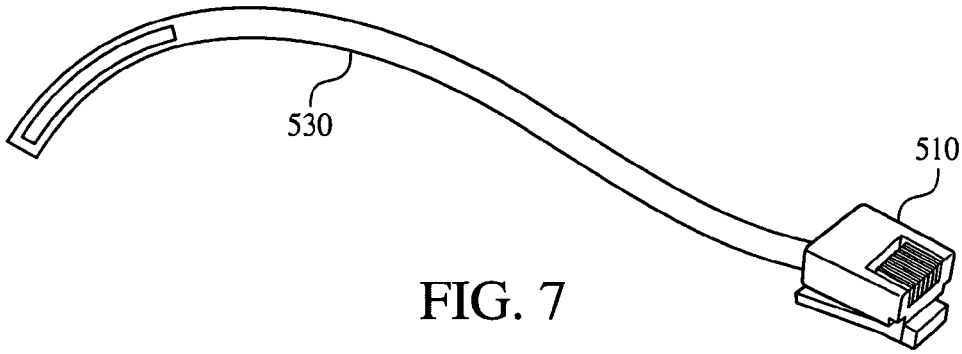
FIG. 7 shows another sensor for use with a security system according to an embodiment of the invention.
Figure 12:
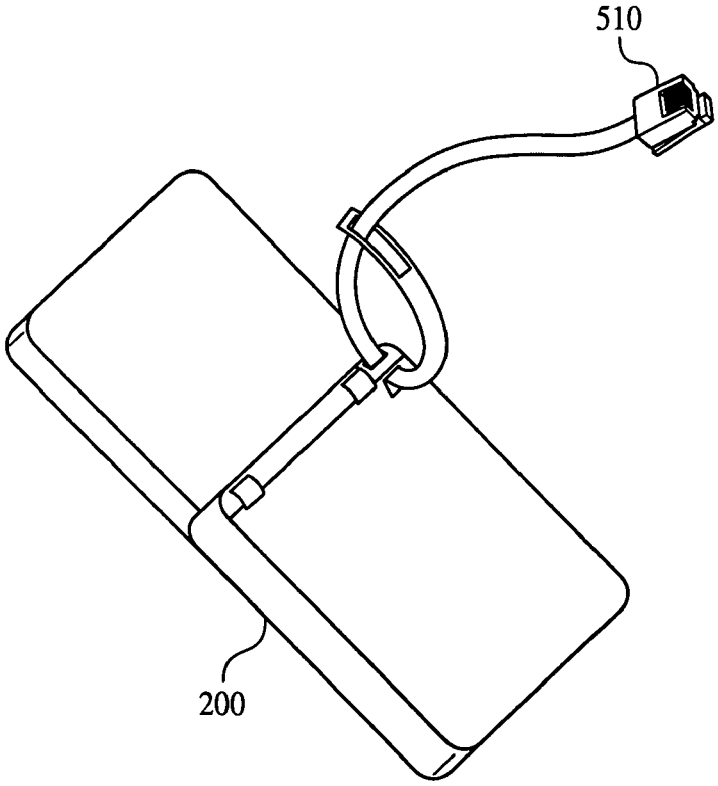
FIG. 12 shows the sensor of FIG. 7 secured to an electronic device according to an embodiment of the invention.

FIG. 7 shows a ribbon sensor assembly. The assembly includes modular connector 510 for coupling the sensor assembly 500 to housing 30. The assembly further comprises a thin, flexible length of ribbon-like material 530. The length of ribbon-like material 530 includes a flexible printed circuit and is secured at one end to modular connector 510. The opposite end of the length of ribbon-like material includes a slit or opening. The size of the slit or opening in the ribbon 530 and the flexible nature of the ribbon material allow modular connector 510 to pass through the slit or opening and form a closed loop. The ribbon sensor assembly may be secured to a displayed electronic device by threading an end of ribbon 530 opposite modular connector 510 through an opening or aperture in electronic device 200, inserting modular connector 510 through the slit provided in ribbon 530, drawing it tight and securing modular connector 510 to housing 30, thereby providing a secure connection. For example, as shown in FIG. 12, a ribbon sensor assembly may be threaded through a wrist strap opening provided in a cellular phone, personal digital assistant or similar device.

The ribbon sensor produces a detectable signal if the printed circuit is broken or cut and/or if modular connector 510 is removed from housing 30. In this way, once a ribbon sensor is secured to an electronic device 200 and housing 30, the electronic device 200 cannot be removed from housing 30 without producing a detectable signal which triggers an alarm when the system is in an armed mode. The detectable signal produced by the ribbon sensor may be transmitted to satellite 80 and/or command module 300 via wireless transmission, along retractable cable 20 or via another cable coupling housing 30 to satellite 80.

Figure 8:
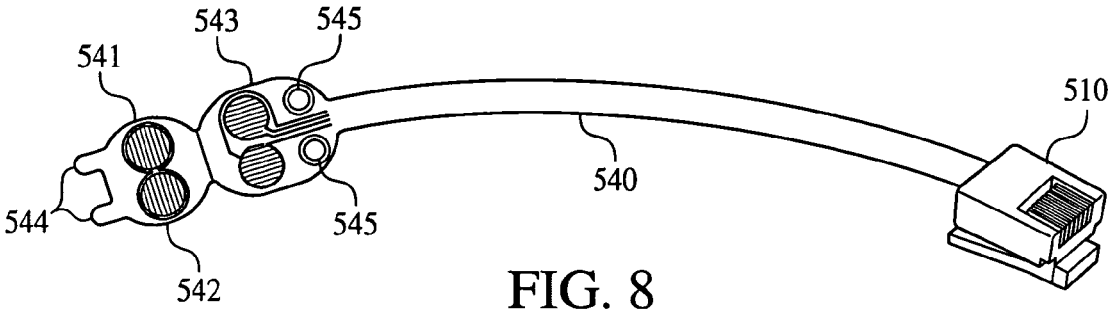
FIG. 8 shows another sensor for use with a security system according to an embodiment of the invention.
Figure 10:
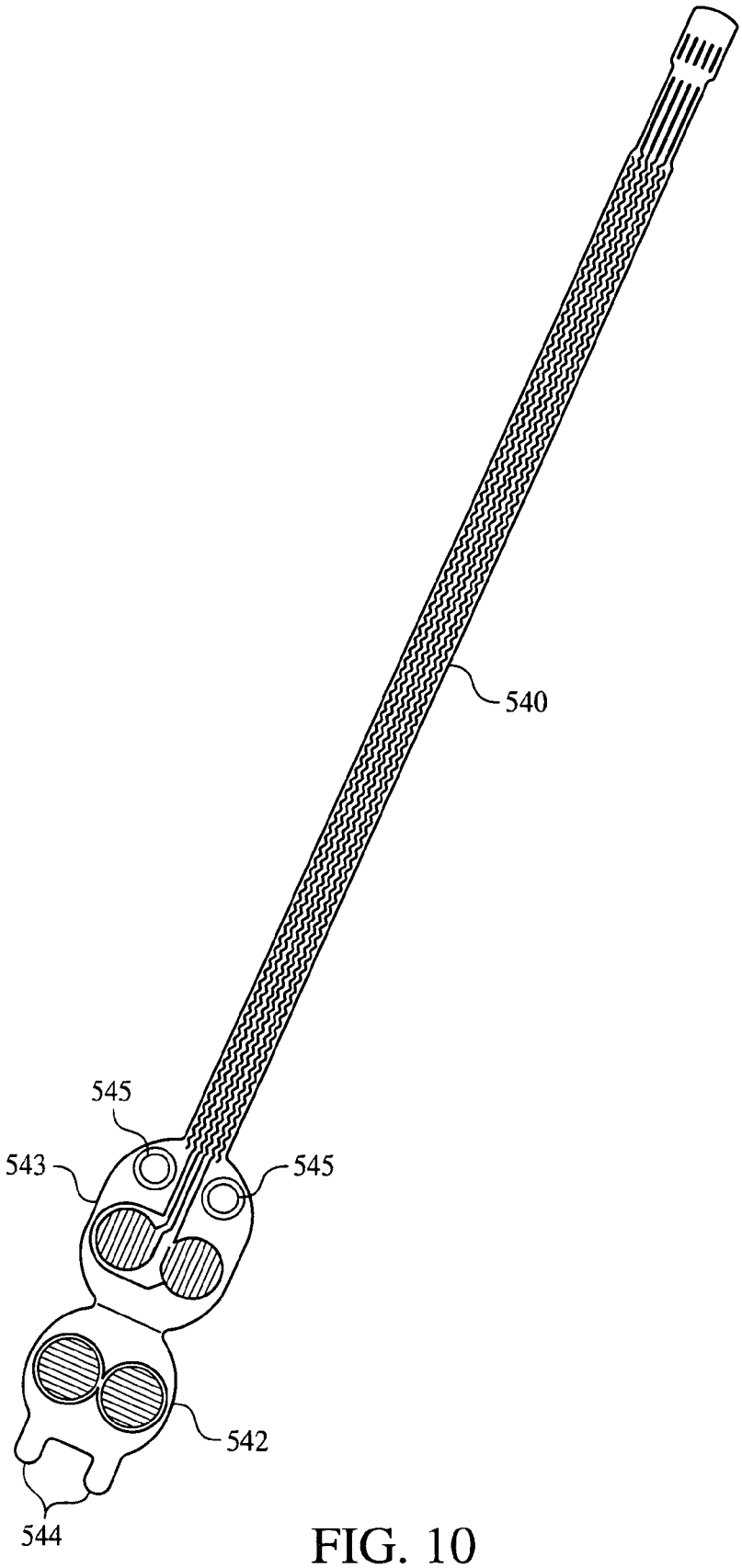
FIG. 10 shows a detailed view of the sensor shown in FIG. 8.

FIG. 8 shows a folding sensor assembly. The assembly includes modular connector 510 for coupling the sensor assembly 500 to housing 30. The assembly further comprises thin, flexible length of ribbon-like material 540 which includes a flexible printed circuit as shown in FIG. 10. The flexible, ribbon-like material may be a non-conductive plastic material, for example, mylar. The printed circuit portion of the folding tag may be formed by masking and applying solder and/or gold, silver, copper or other conductive materials to form conductive traces by dipping, plating or any other appropriate process. Traces may be provided as straight or wiggled lines along a length of ribbon 540 and one or more traces, for example one or more outermost traces may comprise unused, dummy traces to provide an additional degree of security.

The folding sensor assembly has a modular connector 510 at one end for coupling to housing 30 and a folding portion 541 at an opposite end. As shown in FIG. 10, the printed circuit is arranged so that the circuit is completed when an outer member 542 of folding portion 541 is folded over an inner member 543 of folding portion 541. One or more tabs 544 provided on outer member 542 may be inserted into and engage one or more corresponding locating holes 545 provided in inner member 543.

Figure 13:
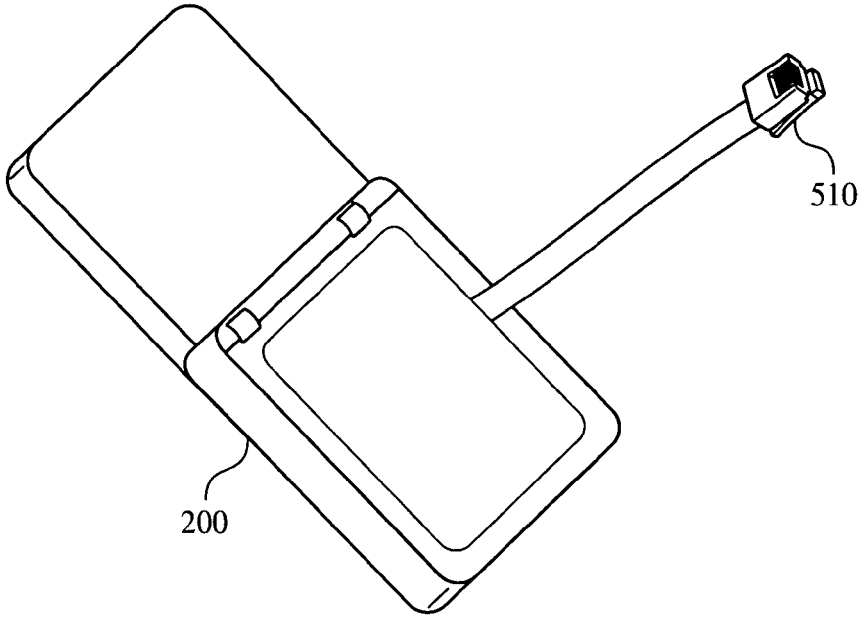
FIG. 13 shows the sensor of FIG. 8 secured to an electronic device according to an embodiment of the invention.

The folding sensor assembly may be secured to a displayed electronic device by folding the folding portion 541, thereby completing the circuit, placing the folded portion in contact with a displayed electronic device 200 such that it is maintained in a folded condition, and coupling the modular connector 510 to housing 30. An adhesive may be used to secure folding portion 541 of the folding sensor assembly to the electronic device 200, housing 30 and/or platform 310. For example, as shown in FIG. 13, a folding portion 541 of a folding sensor may be inserted into a battery compartment of a cellular phone, personal digital assistant or similar device. Additionally, folding portion 541 of a folding sensor may be placed on a back portion of a electronic device 200 and held between the electronic device 200 and housing 30 or platform 310 to maintain it in a folded condition.

The folding sensor produces a detectable signal if the circuit is broken, for example if one of the conductive traces is cut or if the folded portion 541 is opened, thereby breaking the circuit. The folding sensor may also produce a detectable signal if modular connector 510 is removed form housing 30. In this way, once a folding sensor is secured to an electronic device 200 and housing 30, the electronic device 200 cannot be removed from housing 30 without producing a detectable signal which triggers an alarm when the system is in an armed mode. The detectable signal produced by the folding sensor may be transmitted to satellite 80 and/or command module 300 via wireless transmission, along retractable cable 20 or via another cable coupling housing 30 to satellite 80.

Figure 9:
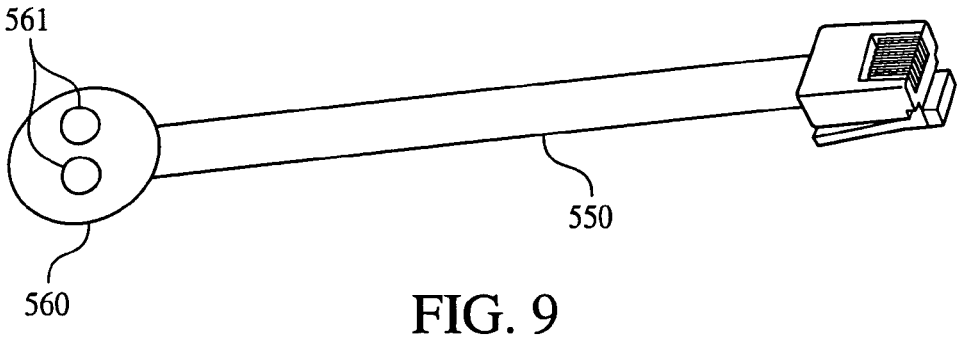
FIG. 9 shows another sensor for use with a security system according to an embodiment of the invention.

FIG. 9 shows a pressure sensor assembly. The assembly includes modular connector 510 at one end for coupling the sensor assembly 500 to housing 30. The assembly further comprises a length of thin, flexible insulating material 550 which encloses one or more conductive elements. At an end opposite modular connector 510, is a pressure sensitive head portion 560. Pressure sensitive head portion 560 may include one or more protrusions 561.

Figure 14:
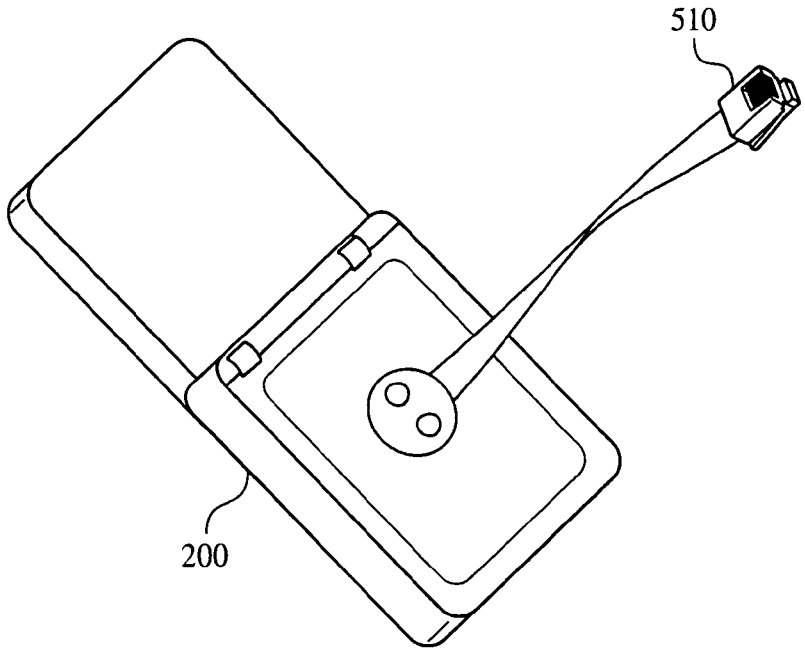
FIG. 14 shows the sensor of FIG. 9 secured to an electronic device according to an embodiment of the invention.

Pressure sensitive head 560 is adapted to be in a secure state when a compressive force is applied to head 560, for example when head 560 is pressed between a portion of an electronic device 200 and housing 30 or platform 310 or between an interior of a battery compartment of an electronic device and a corresponding battery compartment cover. An adhesive may be used to secure pressure sensitive head 560 of the pressure sensor assembly to the electronic device 200, housing 30 and/or platform 310. For example, as shown in FIG. 14, a pressure sensor may be secured to a back portion of electronic device 200 adjacent to housing 30 or platform 310.

Protrusions 561 may enclose, for example, a plurality of conductive elements surrounded by a displaceable non-conductive medium, such as an elastomer. When pressure is applied to the protrusions 561, the non-conductive medium is displaced and the conductive elements are exposed, thereby completing a circuit in the pressure sensor. If pressure is not applied or is withdrawn from the protrusions 561, the non-conductive medium surrounds the conductive elements within the head 560 and breaks the circuit in the pressure sensor.

The pressure sensor produces a detectable signal if the circuit is broken, for example if one of the conductive elements is cut or if pressure is not applied to the pressure sensitive head 560, thereby breaking the circuit. The pressure sensor may also produce a detectable signal if modular connector 510 is removed from housing 30. In this way, once a pressure sensor is secured to an electronic device 200 and housing 30, the electronic device 200 cannot be removed from housing 30 without producing a detectable signal which triggers an alarm when the system is in an armed mode. The detectable signal produced the by the pressure sensor may be transmitted to satellite 80 and/or command module 300 via wireless transmission, along retractable cable 20 or via another cable coupling housing 30 to satellite 80.

Each of the sensor assemblies 500 may be coupled to output voltage controller 40 such that an output voltage to electronic device 200 may be set only when sensor assembly 500 is not in a secure state. For example, an output voltage cannot be set if modular connector 510 of a sensor assembly 500 is engaged with housing 30 and if a circuit of sensor assembly 500 is closed, for example if a folding portion 541 of a folding sensor is folded or if pressure is being applied to a pressure sensitive head of a pressure sensor.

Once an output voltage is set, output voltage controller 40 may reset the output voltage to zero volts if sensor assembly 500 is not placed into a secure state within a predetermined time after the output voltage has been set. For example, an output voltage may be reset to zero automatically if modular connector 510 of a sensor assembly is not engaged with housing 30 within the predetermined time and a folding portion 541 of a folding sensor is not folded or a pressure sensitive head portion 560 of a pressure sensor is not compressed to complete the circuit in the sensor withing the predetermined time. Additionally, an output voltage may be reset to zero if sensor assembly 500 is put into a non-secure or alarmed state following the setting of an output voltage. For example if modular connector 510 is removed from housing 30, or if a circuit in the sensor assembly were broken, for example by cutting the sensor, opening a folding sensor or releasing pressure from a pressure sensor, the output voltage controller 40 may reset an output voltage to zero volts. In this way, voltage to an electronic device is set to zero in the event of an actual or attempted unauthorized removal of or tampering with a secured electronic device. This "auto-zeroing" function of output voltage controller 40 protects against inadvertently providing an inappropriate voltage to an electronic device as described in the foregoing.

Figure 15:
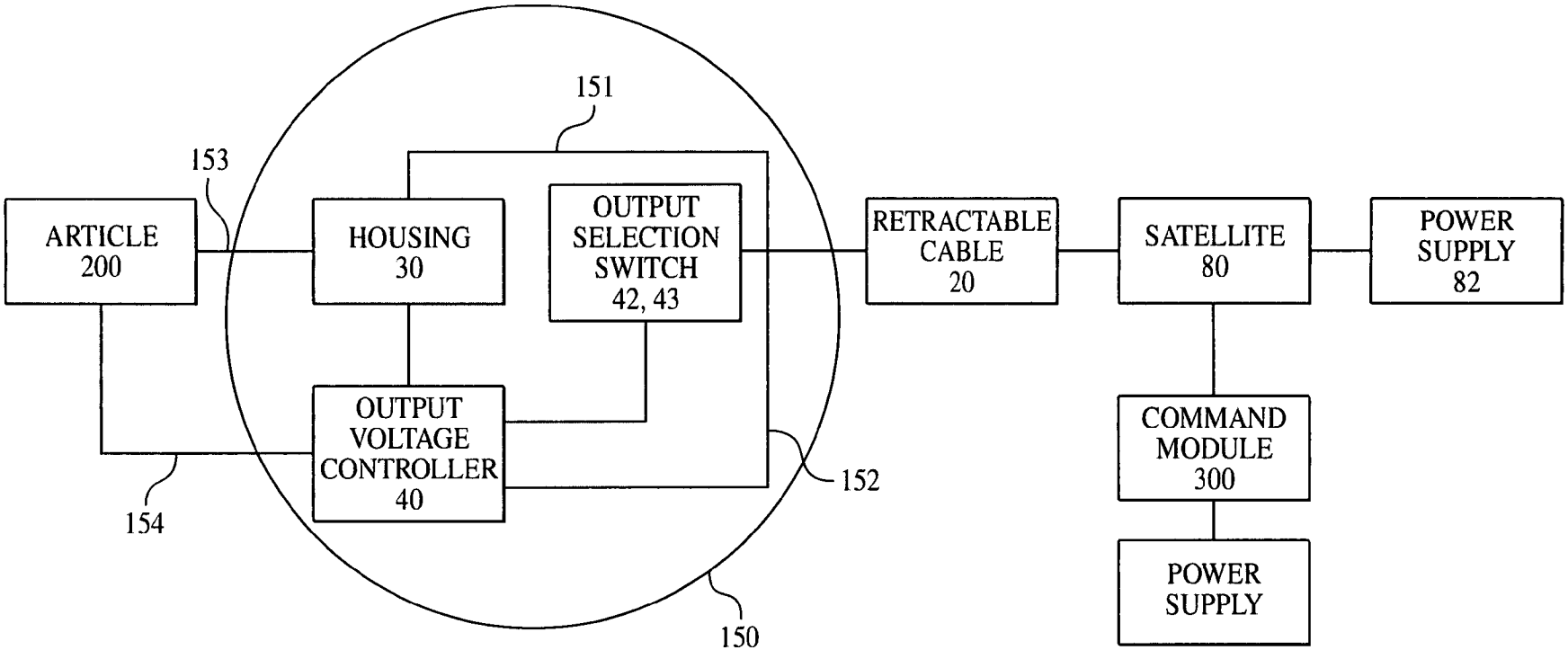
FIG. 15 is a schematic representation showing the operation of a security system according to an embodiment of the invention.

FIG. 15 is a schematic representation showing the operation of a security system according to an embodiment of the invention. In the embodiment shown in FIG. 15, both a security signal 151 and a power signal 152 are communicated via retractable cable 20. Electrical power for the article or handheld electronic device 200 and/or the housing 30 circuitry is provided through retractable cable 20. A power input signal 152 is delivered to output voltage controller 40. An appropriate voltage is selected using voltage selection switches 42, 43 which are in communication with output voltage controller 40, and a power output signal 154 having an appropriate voltage is delivered to article or handheld electronic device 200.

Figure 16:
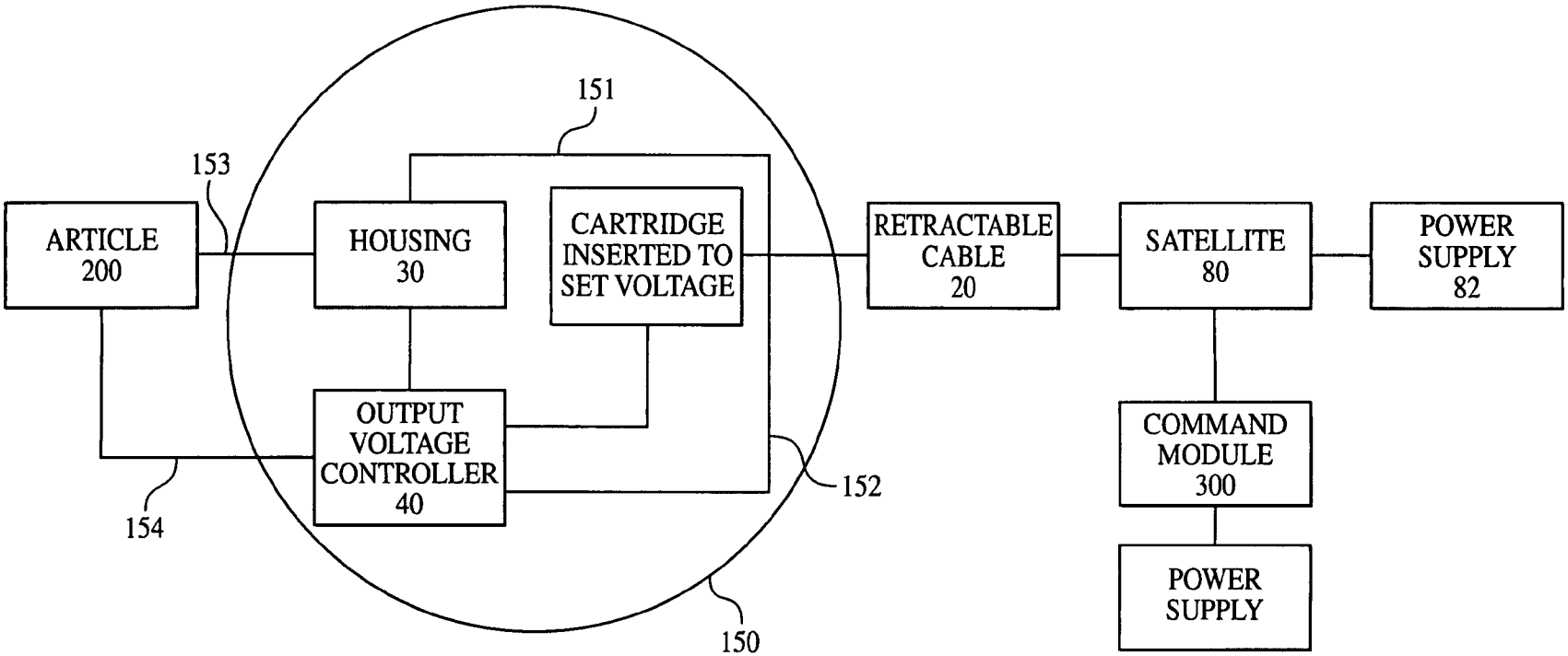
FIG. 16 is a schematic representation showing the operation of a security system according to another embodiment of the invention.

FIG. 16 is a schematic representation showing the operation of a security system according to another embodiment of the invention. In the embodiment shown in FIG. 16, as in the embodiment shown in FIG. 15, both a security signal 151 and a power signal 152 are communicated via retractable cable 20. Electrical power for the article or handheld electronic device 200 and/or for the housing 30 circuitry is provided through retractable cable 20. A power input signal 152 is delivered to output voltage controller 40.

However, as shown in FIG. 16, an appropriate voltage is selected using one or more cartridges, such as a pin-type connector or jumper, which is inserted into a portion of output voltage controller 40. Power output signal 154 having an appropriate voltage is delivered to article or handheld electronic device 200.

Figure 17:
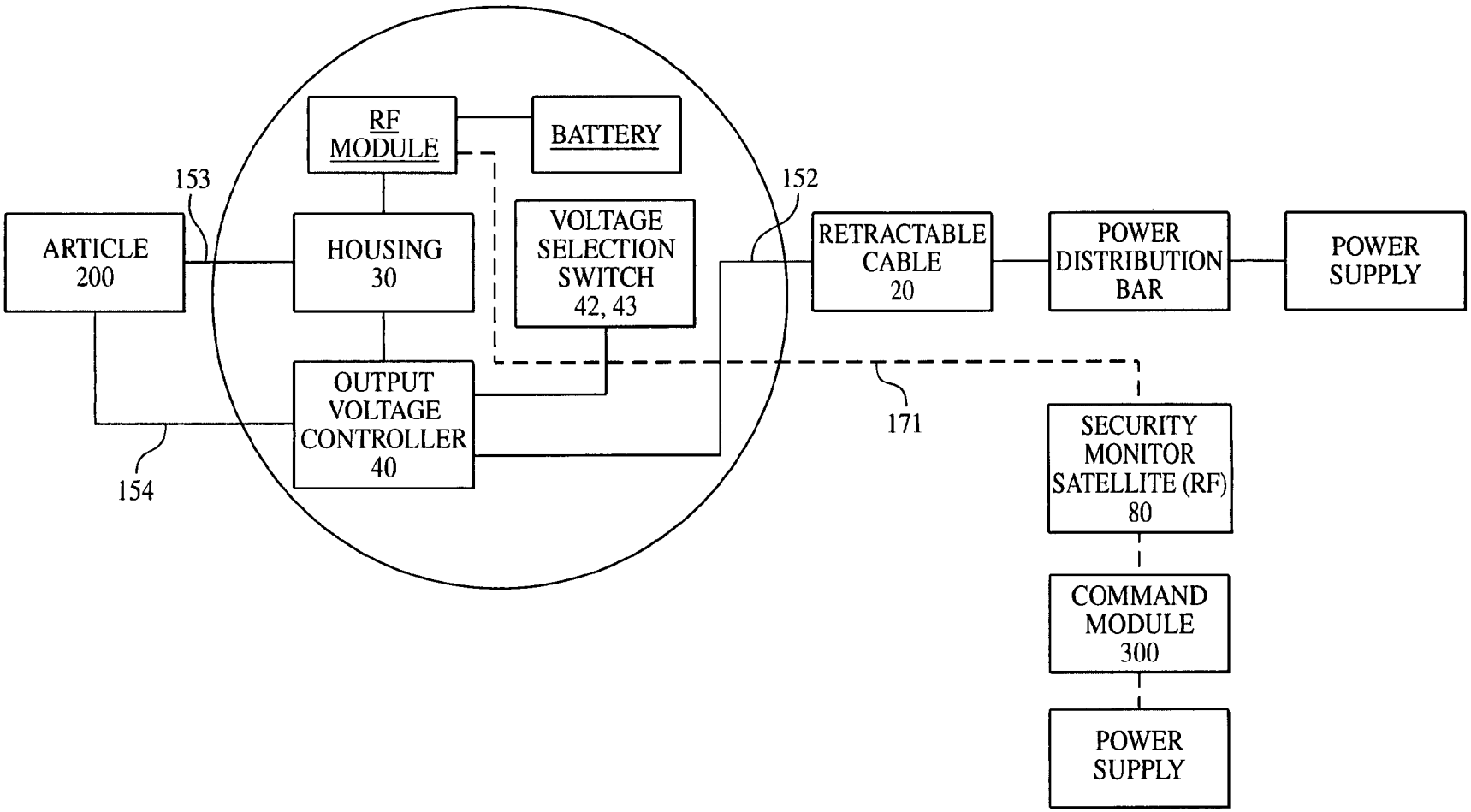
FIG. 17 is a schematic representation showing the operation of a security system according to another embodiment of the invention.

FIG. 17 is a schematic representation of a security system according to another embodiment of the invention. In the embodiment shown in FIG. 17, as in the previous two embodiments, a power signal 152 is communicated via retractable cable 20 and electrical power for the article or handheld electronic device 200 and/or the housing 30 circuitry is provided through retractable cable 20. However, a security signal is not communicated via retractable cable 20, but rather wirelessly. Two-way wireless communication may be provided between housing 30 and a satellite or control unit. For example, as shown, security signal 171 may be transmitted between housing 30 and a satellite or security monitor 80 via a radio frequency (RF) module disposed on housing 30. If housing 30 is moved to an unauthorized state, such as more than a specific distance from a satellite 80 or control unit, the radio frequency module may issue a distress signal which can be detected by the satellite or control unit, causing an alarm.

Figure 18:
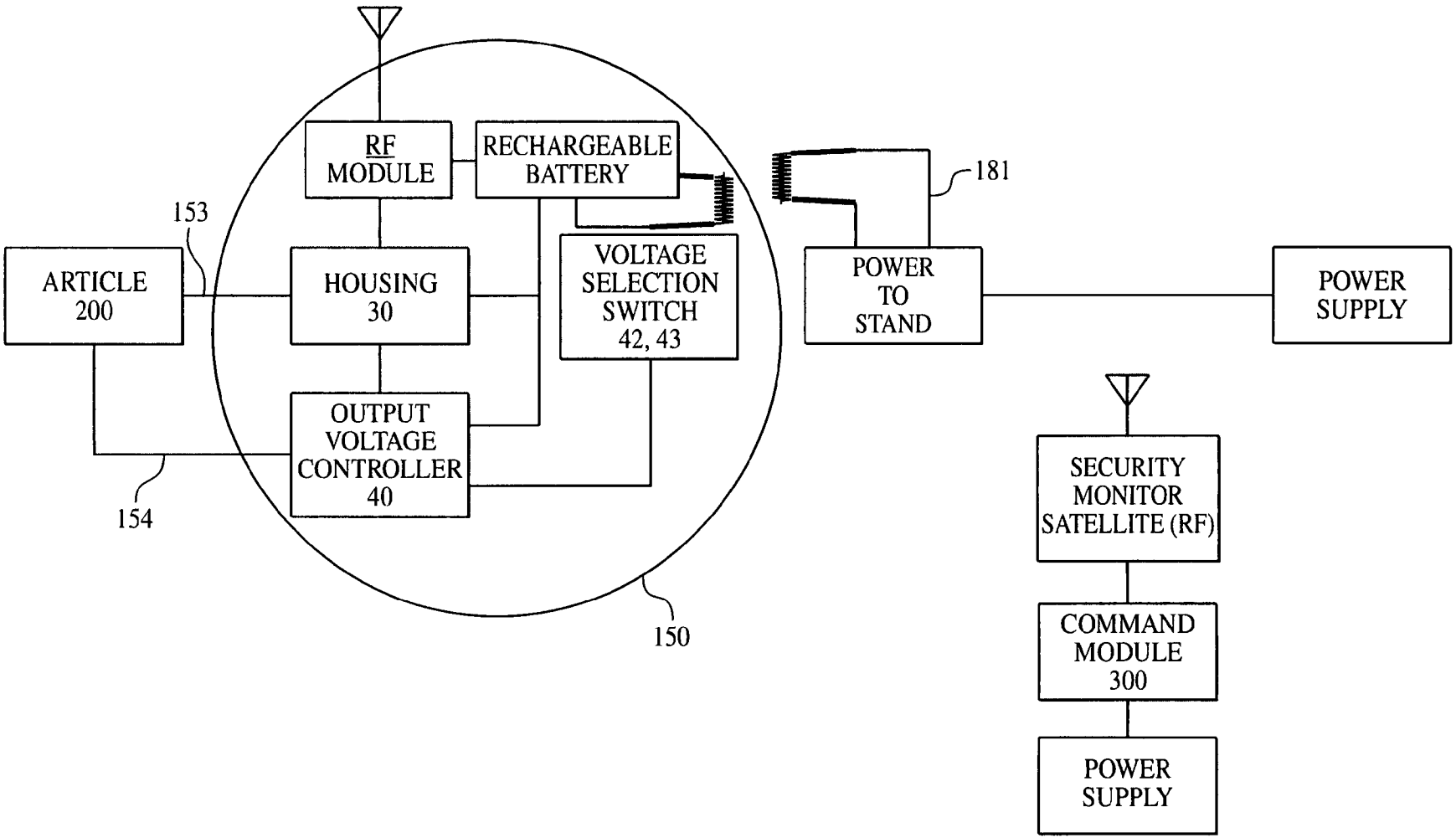
FIG. 18 is a schematic representation showing the operation of a security system according to another embodiment of the invention.

FIG. 18 is a schematic representation of a security system according to another embodiment of the invention. In the embodiment shown in FIG. 18, no retractable cable is required, as neither a power signal 181 nor a security signal are transmitted via a retractable cable. Rather, two-way wireless communication may be provided between housing 30 and a satellite or control unit. For example, as shown, a security signal may be transmitted between housing 30 and a satellite or security monitor 80 via a radio frequency (RF) module disposed on housing 30. If housing 30 is moved to an unauthorized state, such as more than a specific distance from a satellite 80 or control unit, the radio frequency module may issue a distress signal which can be detected by the satellite or control unit, causing an alarm.

Furthermore, a power signal 181 for powering article or handheld electronic device 200 and/or housing 30 circuitry may be delivered to a wireless, induction-type charger in stand assembly 10 for charging a rechargeable battery 44. Rechargeable battery 44 is disposed in housing 30 and provides electrical power for article or handheld electronic device 200 an/or housing 30. Battery 44 may be charged in a non contact manner when housing 30 is seated in stand assembly 10. Although, a retractable cable is not required for transmitting power or security signals in the embodiment shown in FIG. 18, a retractable cable may be included with this embodiment. Such a retractable cable may serve as a mechanical tether for securing housing 30 to a support.

Accordingly, while several embodiments of the present invention have been shown and described, it is obvious that many changes and modifications may be made thereunto without departing from the spirit and scope of the invention.

What is claimed is:

1. A security system for displaying a handheld electronic device, the security system comprising:

a) a stand assembly mounted to a support;

b) a housing removably mounted on a top portion of said stand assembly, said housing comprising a top surface adapted to receive the handheld electronic device;

c) a sensor adapted to be coupled to said housing and to the handheld electronic device, said sensor having a secure state and a non-secure state, wherein said sensor produces a detectable signal when said sensor is in said non-secure state;

d) a output voltage controller coupled to said housing for controlling an output voltage to the handheld electronic device, wherein said output voltage can be set only when said sensor is in said non-secure state and wherein said output voltage is set to zero if said sensor is not placed in a secure state within a predetermined time after setting said output voltage;

e) a power cable coupling said output voltage controller to the handheld electronic device;

f) a retractable cable coupled to said housing;

g) a control unit for receiving the detectable signal from said sensor, wherein said control unit is in electrical communication with said output voltage controller; and h) a power supply coupled to said control unit.

2. The security system according to claim 1, wherein said control unit further comprises a satellite and a control module.

3. The security system according to claim 1, wherein said top surface of said housing is adapted to display said handheld electronic device at an angle with respect to a horizontal plane.

4. The security system according to claim 3, wherein said angle comprises an angle in the range of approximately 30 to 60 degrees.

5. The security system according to claim 1, wherein said output voltage is set to zero if said sensor is placed in said secure state within said predetermined time after setting said output voltage and said sensor is subsequently placed in said non-secure state.

6. The security system according to claim 1, wherein said sensor comprises a modular connector adapted to engage said housing and wherein said sensor is placed in said non-secure state when said modular connector is not engaged with said housing.

7. The security system according to claim 6, wherein said power cable comprises a connector adapted to engage said housing and wherein when said sensor modular connector is engaged with said housing and said power cable connector is engaged with said housing said power cable connector cannot be disengaged from said housing without first disengaging said sensor modular connector.

8. The security system according to claim 1, wherein said sensor comprises at least one conductive element wherein said sensor is placed in said non-secure state when said at least one conductive element is broken.

9. The security system according to claim 1, wherein said sensor comprises a wire loop sensor.

10. The security system according to claim 1, wherein said sensor comprises a flexible printed circuit ribbon having a slit disposed at an end thereof.

11. The security system according to claim 1, wherein said sensor comprises a folding sensor.

12. The security system according to claim 1, wherein said sensor comprises a pressure sensor.

13. The security system according to claim 1, wherein said stand assembly comprises one or more sections, each of said one or more sections having a bore for routing said retractable cable.

14. The security system according to claim 13, wherein said one or more sections comprise a plurality of sections which are secured together in an interlocking manner.

15. The security system according to claim 14, wherein one or more of said plurality of sections comprise a threaded portion.

16. The security system according to claim 14, wherein said plurality of sections includes one or more sections of differing lengths.

17. The security system according to claim 1, wherein said top portion of said stand assembly further comprises a collar having a cavity adapted to receive a portion of said housing and wherein said collar and said housing are shaped such that said housing is centered in said stand assembly when mounted thereon.

18. The security system according to claim 1, wherein said handheld electronic device is secured to said housing with an adhesive.

19. The security system according to claim 1, wherein said handheld electronic device is secured to said housing with a flexible locking band.

20. The security system according to claim 1, further comprising a detangler coupled to said retractable cable.

21. A security system for displaying a handheld electronic device engaged with a docking station, the security system comprising:

a) a stand assembly mounted to a support;

b) a housing removably mounted on a top portion of said stand assembly, said housing comprising a top surface adapted to receive the docking station;

c) a sensor adapted to be coupled to said housing and to the handheld electronic device, said sensor having a secure state and a non-secure state, wherein said sensor produces a detectable signal when said sensor is in said non-secure state;

d) a output voltage controller coupled to said housing for controlling an output voltage to the handheld electronic device, wherein said output voltage can be set only when said sensor is in said non-secure state and wherein said output voltage is set to zero if said sensor is not placed in a secure state within a predetermined time after setting said output voltage;

e) a power cable coupling said output voltage controller to the handheld electronic device;

f) a retractable cable coupled to said housing;

g) a control unit for receiving the detectable signal from said sensor, wherein said control unit is in electrical communication with said output voltage controller; and h) a power supply coupled to said control unit.

22. The security system according to claim 21, wherein said top surface of said housing is adapted to display said docking station at an angle with respect to a horizontal plane.

23. The security system according to claim 22, wherein said angle comprises an angle in the range of approximately 30 to 60 degrees.

24. The security system according to claim 21, wherein said control unit further comprises a satellite and a control module.

25. The security system according to claim 21, wherein said output voltage is set to zero if said sensor is placed in said secure state within said predetermined time after setting said output voltage and said sensor is subsequently placed in said non-secure state.

26. The security system according to claim 21, wherein said sensor comprises a modular connector adapted to engage said housing and wherein said sensor is placed in said non-secure state when said modular connector is not engaged with said housing.

27. The security system according to claim 26, wherein said power cable comprises a connector adapted to engage said housing and wherein when said sensor modular connector is engaged with said housing and said power cable connector is engaged with said housing said power cable connector cannot be disengaged from said housing without first disengaging said sensor modular connector.

28. The security system according to claim 21, wherein said sensor comprises at least one conductive element wherein said sensor is placed in said non-secure state when said at least one conductive element is broken.

29. The security system according to claim 21, wherein said sensor comprises a wire loop sensor.

30. The security system according to claim 21, wherein said sensor comprises a flexible printed circuit ribbon having a slit disposed at an end thereof.

31. The security system according to claim 21, wherein said sensor comprises a folding sensor.

32. The security system according to claim 21, wherein said sensor comprises a pressure sensor.

33. The security system according to claim 21, wherein said stand assembly comprises one or more sections, each of said one or more sections having a bore for routing said retractable cable.

34. The security system according to claim 33, wherein said one or more sections comprise a plurality of sections which are secured together in an interlocking manner.

35. The security system according to claim 34, wherein one or more of said plurality of sections comprise a threaded portion.

36. The security system according to claim 34, wherein said plurality of sections includes one or more sections of differing lengths.

37. The security system according to claim 21, wherein said top portion of said stand assembly further comprises a collar having a cavity adapted to receive a portion of said housing and wherein said collar and said housing are shaped such that said housing is centered in said stand assembly when mounted thereon.

38. The security system according to claim 21, wherein the docking station is secured to said housing with an adhesive.

39. The security system according to claim 21, wherein the docking station is secured to said housing with a flexible locking band.

40. The security system according to claim 21, further comprising a detangler coupled to said retractable cable.

41. A security system for displaying a handheld electronic device, the security system comprising:

a) a stand assembly mounted to a support;

b) a housing removably mounted on a top portion of said stand assembly, said housing comprising a top surface adapted to receive the handheld electronic device;

c) a sensor adapted to be coupled to said housing and to the handheld electronic device, said sensor having a secure state and a non-secure state, wherein said sensor produces a detectable signal when said sensor is in said non-secure state;

d) a output voltage controller coupled to said housing for controlling an output voltage to the handheld electronic device;

e) a power cable coupling said output voltage controller to the handheld electronic device;

f) a battery coupled to said output voltage controller and disposed in said housing for powering said handheld electronic device;

g) a control unit for receiving the detectable signal from said sensor via a wireless transmission; and h) a power supply coupled to said control unit.

42. The security system according to claim 41 wherein said battery comprises a rechargeable battery and said stand assembly further comprises an induction charger for charging said rechargeable battery when said housing is mounted on said stand assembly.

43. The security system according to claim 41, further comprising a retractable cable coupled to said housing for mechanically securing said housing to the support.

44. The security system according to claim 43, further comprising a detangler coupled to said retractable cable.

45. The security system according to claim 41, wherein said output voltage can be set only when said sensor is in said non-secure state and wherein said output voltage is set to zero if said sensor is not placed in a secure state within a predetermined time after setting said output voltage.

46. The security system according to claim 41, wherein said control unit further comprises a satellite and a control module.

47. The security system according to claim 41, wherein said top surface of said housing is adapted to display said handheld electronic device at an angle with respect to a horizontal plane.

48. The security system according to claim 47, wherein said angle comprises an angle in the range of approximately 30 to 60 degrees.

49. The security system according to claim 41, wherein said output voltage is set to zero if said sensor is placed in said secure state within said predetermined time after setting said output voltage and said sensor is subsequently placed in said non-secure state.

50. The security system according to claim 41, wherein said sensor comprises a modular connector adapted to engage said housing and wherein said sensor is placed in said non-secure state when said modular connector is not engaged with said housing.

51. The security system according to claim 50, wherein said power cable comprises a connector adapted to engage said housing and wherein when said sensor modular connector is engaged with said housing and said power cable connector is engaged with said housing said power cable connector cannot be disengaged from said housing without first disengaging said sensor modular connector.

52. The security system according to claim 41, wherein said sensor comprises a radio frequency module.

53. The security system according to claim 41, wherein said stand assembly comprises one or more sections, each of said one or more sections having a bore for routing said retractable cable.

54. The security system according to claim 53, wherein said one or more sections comprise a plurality of sections which are secured together in an interlocking manner.

55. The security system according to claim 53, wherein one or more of said plurality of sections comprise a threaded portion.

56. The security system according to claim 54, wherein said plurality of sections includes one or more sections of differing lengths.

57. The security system according to claim 41, wherein said top portion of said stand assembly further comprises a collar having a cavity adapted to receive a portion of said housing and wherein said collar and said housing are shaped such that said housing is centered in said stand assembly when mounted thereon.

58. The security system according to claim 41, wherein said handheld electronic device is secured to said housing with an adhesive.

59. The security system according to claim 41, wherein said handheld electronic device is secured to said housing with a flexible locking band.

* * * * *